US007719485B2

(12) United States Patent
Myoung et al.

(10) Patent No.: US 7,719,485 B2
(45) Date of Patent: May 18, 2010

(54) PLASMA DISPLAY APPARATUS AND DRIVING METHOD THEREOF

(75) Inventors: Dae Jin Myoung, Goyang-si (KR); Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 1141 days.

(21) Appl. No.: 11/289,414

(22) Filed: Nov. 30, 2005

(65) Prior Publication Data

US 2006/0238453 A1 Oct. 26, 2006

(30) Foreign Application Priority Data

Apr. 21, 2005 (KR) ..... 10-2005-0033305
Apr. 27, 2005 (KR) ..... 10-2005-0035266

(51) Int. Cl.
*G09G 3/28* (2006.01)

(52) U.S. Cl. ..... 345/60; 345/63; 345/65; 345/67; 345/61

(58) Field of Classification Search ..... 345/37, 345/41, 55, 60–69, 99, 204; 315/169.1–169.4; 313/484, 585
See application file for complete search history.

(56) References Cited

U.S. PATENT DOCUMENTS 5,874,932 A * 2/1999 Nagaoka et al. ..... 345/60
6,084,558 A * 7/2000 Setoguchi et al. ..... 345/60
6,384,802 B1 * 5/2002 Moon ..... 345/60
6,559,816 B1 * 5/2003 Koo et al. ..... 345/60
6,603,446 B1 * 8/2003 Kanazawa et al. ..... 345/60
6,646,625 B1 * 11/2003 Shigeta et al. ..... 345/63
6,717,557 B2 * 4/2004 Ishizuka ..... 345/60
6,784,857 B1 * 8/2004 Nakamura ..... 345/60
6,862,007 B2 * 3/2005 Shoji et al. ..... 345/60
7,151,510 B2 * 12/2006 Whang et al. ..... 345/66
7,196,680 B2 * 3/2007 Park ..... 345/63
7,312,768 B2 * 12/2007 Kang et al. ..... 345/63
2001/0011975 A1 * 8/2001 Ishizuka ..... 345/60
2003/0080928 A1 * 5/2003 Shoji et al. ..... 345/63
2003/0107532 A1 * 6/2003 Choi ..... 345/60
2003/0234753 A1 * 12/2003 Tanaka ..... 345/67

(Continued)

FOREIGN PATENT DOCUMENTS

JP 2005-070784 3/2005

(Continued)

*Primary Examiner*—Prabodh M Dharia
(74) *Attorney, Agent, or Firm*—McKenna Long & Aldridge LLP

(57) ABSTRACT

The present invention relates to a plasma display apparatus and driving method thereof, and more particularly, to a plasma display apparatus implementing gray levels and driving method thereof. The plasma display apparatus according to the present invention comprises a plasma display panel in which a plurality of scan electrodes and a plurality of sustain electrodes are formed on a substrate, drivers for driving the plurality of the scan electrodes and the sustain electrodes, and a sustain pulse controller for controlling the drivers to set a total number of sustain pulses applied to the scan electrodes and the sustain electrodes to be at least one or more of a plurality of sub-fields in which a sub-field having an odd number constitutes one frame. The present invention can implement a finer gray level. Accordingly, half-tone noise when implementing a low gray level can be reduced and the picture quality can be improved.

20 Claims, 19 Drawing Sheets

U.S. PATENT DOCUMENTS

| | | | | |
|---|---|---|---|---|
| 2005/0007314 | A1 | 1/2005 | Kang | |
| 2005/0035935 | A1* | 2/2005 | Kang et al. | 345/87 |
| 2005/0057443 | A1* | 3/2005 | Whang et al. | 345/60 |
| 2005/0083252 | A1 | 4/2005 | Roh et al. | |
| 2005/0116889 | A1* | 6/2005 | Whang et al. | 345/60 |
| 2005/0116891 | A1* | 6/2005 | Han | 345/60 |
| 2005/0116898 | A1* | 6/2005 | Chae | 345/60 |
| 2005/0168406 | A1* | 8/2005 | Lee et al. | 345/60 |
| 2005/0232278 | A1* | 10/2005 | Anderson | 370/395.52 |
| 2005/0237274 | A1* | 10/2005 | Moon | 345/60 |
| 2005/0264230 | A1* | 12/2005 | Kim et al. | 315/169.4 |
| 2006/0114184 | A1 | 6/2006 | Kim | |
| 2006/0232507 | A1* | 10/2006 | Myoung et al. | 345/60 |
| 2008/0117141 | A1* | 5/2008 | Yoon et al. | 345/68 |

FOREIGN PATENT DOCUMENTS

| | | | |
|---|---|---|---|
| KR | 10-2004-0006571 | A | 1/2004 |
| KR | 1020040006571 | | 1/2004 |
| KR | 10-2005-0020863 | A | 3/2005 |
| KR | 1020050020863 | | 3/2005 |
| KR | 1020060041592 | | 5/2006 |

* cited by examiner

PLASMA DISPLAY APPARATUS AND DRIVING METHOD THEREOF

CROSS-REFERENCE TO RELATED APPLICATIONS

This Nonprovisional application claims priority under 35 U.S.C. §119(a) on Patent Application Nos. 10-2005-0033305 and 10-2005-0035266 filed in Korea on Apr. 21, 2005 and Apr. 27, 2005 the entire contents of which are hereby incorporated by reference.

BACKGROUND OF THE INVENTION

1. Field of the Invention

The present invention relates to a plasma display apparatus and driving method thereof, and more particularly, to a plasma display apparatus realizing gray levels and a driving method thereof.

2. Background of the Related Art

In a conventional plasma display panel, a barrier rib formed between a front panel and a rear panel forms one unit cell. Each cell is filled with a primary discharge gas, such as neon (Ne), helium (He) or a mixed gas of Ne and He, and an inert gas containing a small amount of xenon. If the inert gas is discharged with a high frequency voltage, it generates vacuum ultraviolet rays. The vacuum ultraviolet rays excite phosphors formed between the barrier ribs, thus implementing images. This plasma display panel can be manufactured to be light brightness weight, and has thus been considered one of the next-generation display devices.

FIG. 1 illustrates the construction of a conventional plasma display panel. As shown in FIG. 1, the plasma display panel comprises a front panel 100 and a rear panel 110. In the front panel 100, a plurality of sustain electrode pairs in which a plurality of scan electrodes 102 and sustain electrodes 103 form pairs are arranged on a front glass 101, i.e., a display surface on which images are displayed. In the rear panel 110, a plurality of address electrodes 113 disposed to intersect the plurality of sustain electrode pairs are arranged on a rear glass 111, i.e., a rear surface. The front panel 100 and the rear panel 110 are parallel to each other with a predetermined distance therebetween.

The front panel 100 comprises the pairs of scan electrodes 102 and sustain electrodes 103, which mutually discharge each other and maintain the emission of a cell in one discharge cell. In other words, each of the scan electrode 102 and the sustain electrode 103 has a transparent electrode "a" made of a transparent ITO material and a bus electrode "b" made of a metal material. The scan electrodes 102 and the sustain electrodes 103 are covered with one or more upper dielectric layers 104 for limiting the discharge current and providing insulation among the electrode pairs. A protection layer 105 having magnesium oxide (MgO) deposited thereon is formed on the dielectric layers 104 to facilitate a discharge condition.

In the rear panel 110, barrier ribs 112 of stripe form (or well form), for forming a plurality of discharge spaces, i.e., discharge cells are arranged parallel to one another. A plurality of address electrodes 113, which generate vacuum ultraviolet rays by performing an address discharge, are disposed parallel to the barrier ribs 112. R, G and B phosphors 114 that emit a visible ray for displaying images during an address discharge are coated on a top surface of the rear panel 110. A low dielectric layer 115 for protecting the address electrodes 113 is formed between the address electrodes 113 and the phosphors 114.

A method of implementing images gray levels in the conventional plasma display panel constructed above will be described below with reference to FIG. 2.

FIG. 2 illustrates a method of implementing image gray levels in the conventional plasma display panel.

As shown in FIG. 2, to implement image gray levels in the conventional plasma display panel, one frame is divided into several sub-fields, each sub-field having a different number of emissions. Each sub-field is subdivided into a reset period RPD for initializing the entire cells, an address period APD for selecting a cell to be discharged, and a sustain period SPD for implementing gray levels depending on the number of discharges. For example, to display images with 256 gray levels, a frame period (16.67 ms) corresponding to 1/60 seconds is divided into eight sub-fields SF1 to SF8, as shown in FIG. 2. Each of the eight sub-fields SF1 to SF8 is again divided into a reset period, an address period and a sustain period.

The reset period and the address period of each sub-field are the same. An address discharge for selecting a cell to be discharged is generated due to a voltage difference between the address electrodes and the scan electrodes, i.e., transparent electrodes. The sustain period increases in the ratio of $2^n$ (where, n=0,1,2,3,4,5,6,7) in each sub-field. As described above, since the sustain period is changed in each sub-field, image gray levels are implemented by controlling the sustain period of each sub-field, i.e., a sustain discharge number.

FIG. 3 shows a driving waveform depending on the driving method of the conventional plasma display panel.

As shown in FIG. 3, the plasma display panel is driven with it being divided into a reset period for initializing all of the cells, an address period for selecting cells to be discharged, a sustain period for sustaining the discharge of the selected cells, and an erase period for erasing wall charges within the discharged cells.

In a set-up period of the reset period, a ramp-up pulse (Ramp-up) is applied to all of the scan electrodes at the same time. The ramp-up pulse generates a dark discharge within the discharge cells of the entire screen. The set-up discharge causes positive wall charges to be accumulated on the address electrodes and the sustain electrodes, and negative wall charges to be accumulated on the scan electrodes.

In a set-down period of the reset period, after the ramp-up pulse is applied, a ramp-down pulse (Ramp-down), which starts falling from a positive voltage lower than a peak voltage of the ramp-up pulse up to a predetermined voltage level lower than a ground (GND) level voltage, generates a weak erase discharge within the cells, thereby sufficiently erasing wall charges excessively formed on the scan electrodes. The set-down discharge causes wall charges of the degree in which an address discharge can occur stably to uniformly remain within the cells.

In the address period, while a negative scan pulse is sequentially applied to the scan electrodes, a positive data pulse is applied to the address electrodes in synchronization with the scan pulse. As a wall voltage generated in the reset period is added to a voltage difference between the scan pulse and the data pulse, an address discharge is generated within the discharge cells to which the data pulse is applied. Wall charges of the degree in which a discharge can occur when a sustain voltage (Vs) is applied are formed within the cells selected by an address discharge. The sustain electrode is supplied with a positive voltage (Vz) to reduce between the sustain electrode and the scan electrodes during the set-down period and the address period so that an erroneous discharge is not generated between the sustain electrode and the scan electrodes.

In the sustain period, a sustain pulse (SUS) is alternately applied to the scan electrodes and the sustain electrode. In cells selected by an address discharge, a sustain discharge, i.e., a display discharge is generated between the scan electrodes and the sustain electrodes whenever a sustain pulse is added to the wall voltage within the cell selected by the address discharge.

After the sustain discharge finishes, in the erase period, a voltage of an erase ramp pulse (Ramp-ers) having a narrow pulse width and a low voltage level is applied to the sustain electrodes, thereby erasing wall charges remaining within the cells of the entire screen.

A discharge that may influence the implementation of the gray levels is the address discharge generating in the address period and the sustain discharge generating in the sustain period. Light generated by these discharges is radiated outwardly, thereby implementing gray levels.

FIG. 4 illustrates a discharge affecting the implementation of gray levels in the driving waveform shown in FIG. 3.

As shown in FIG. 4, in a region A of the driving waveform shown in FIG. 3, an address discharge is generated between the scan electrodes Y and the address electrodes X in the address period. In a region B of the driving waveform shown in FIG. 3, a sustain discharge is generated between the scan electrodes Y and the sustain electrode Z in the sustain period. Light generated by the address discharge and the sustain discharge affects the implementation of gray levels. Although a reset discharge is generated in the reset period, the reset discharge is generated within all of the discharge cells on the plasma display panel. Therefore, light generated by this reset discharge does not affect the implementation of gray levels.

In such a conventional driving waveform, an integral multiple of a pair of sustain pulses is applied to the scan electrodes and the sustain electrode in the sustain period of each sub-field. Accordingly, gray levels are implemented upon a display discharge. If the integral multiple of a pair of sustain pulses are applied as described above, the amount of light generated during the sustain period becomes excessive. As a result, a problem arises in that the implementation of the gray levels is deteriorated in low gray level sub-fields for implementing low gray levels.

Another problem arises in that the picture quality is degraded since a substantial amount of half-tone noise is generated by the conventional sustain discharge and the address discharge.

FIG. 5 illustrates an example of a method of implementing low gray levels of 1 or less in the driving waveform shown in FIG. 3.

It is assumed that the light implemented by the driving waveform in the first sub-field SF1 of FIG. 3 is light implementing the gray level 2. As shown in FIG. 5, the number of discharge cells C that are turned off and discharge cells D that are turned on to implement gray levels of 0.5 in a region comprising a total of 16 discharge cells on the plasma display panel is controlled, thus generally implementing gray levels of 0.5. The reason why light implemented by the driving waveform of FIG. 3 is light implementing the gray level 2 is that it is assumed that one sustain pulse implements the gray level 1 for the convenience of this discussion. Since two sustain pulses are supplied in the driving waveform of the first sub-field SF1 of FIG. 3, a total of two gray levels is implemented. Accordingly, one discharge cell that is turned on in FIG. 5 radiates light that implements two gray levels. If a total of three discharge cells is turned off and one discharge cell is turned on in a region 600 comprsising four discharge cells as shown in FIG. 5, the discharge cells of each region 600 consisting of four discharge cells implement a 0.5 gray level. This method employs a person's optical illusion phenomenon, which is one of half-tone schemes.

In the conventional gray-level implementation method, however, a difference in the brightness between the discharge cells that are turned on and the discharge cells that are turned off is relatively high due to an address discharge and a sustain discharge formed as an integral multiple of a pair of sustain pulses is applied. Since the number of discharge cells that are turned on is relatively smaller than the number of discharge cells that are turned off, the picture quality spreads at the boundary portion of images. Accordingly, problems arise in that significant half-tone noise is generated and the picture quality is degraded.

SUMMARY OF THE INVENTION

Accordingly, the present invention has been made in view of the above problems, and it is an object of the present invention to provide a plasma display apparatus and driving method thereof, in which the implementation of gray levels can be enhanced by controlling the number of sustain pulses applied in a sustain period of each sub-field.

Another object of the present invention is to provide a plasma display apparatus and driving method thereof, in which half-tone noise can be reduced.

To achieve the above objects, a plasma display apparatus according to the present invention comprises a plasma display panel in which a scan electrode and a sustain electrode are formed on a substrate, a scan driver driving the scan electrode, a sustain driver driving the sustain electrode and a sustain pulse controller controlling the scan driver and the sustain driver to set the number of sustain pulses applied to the scan electrode and the sustain electrode in at least one sub-field in a plurality of sub-fields in a frame to an odd number.

According to the present invention, there is provided a driving apparatus of a plasma display panel in which a scan electrode and a sustain electrode are formed on a substrate, comprising a scan driver driving the scan electrode, a sustain driver driving the sustain electrode and a sustain pulse controller controlling the scan driver and the sustain driver to set the number of sustain pulses applied to the scan electrode and the sustain electrode in at least one sub-field in a plurality of sub-fields in a frame to an odd number.

According to the present invention, there is provided a plasma display panel in which a scan electrode and a sustain electrode are formed on a substrate, wherein the panel is driven so that the number of sustain pulses applied to the scan electrode and the sustain electrode in at least one sub-field in a plurality of sub-fields in a frame is an odd number.

According to the present invention, there is provided a driving method of a plasma display apparatus displaying an image with a plurality of sub-fields, wherein a number of sustain pulses applied in at least one sub-field of the plurality of sub-fields is an odd number.

A plasma display apparatus according to the present invention comprises a plasma display panel comprising a scan electrode and a sustain electrode, a driver driving the scan electrode and the sustain electrode and a driving controller controlling the driver to set a bias voltage applied to the sustain electrode in an address period of at least one of sub-fields constituting a frame, to be different from the bias voltages which are applied to the sustain electrode in address periods of the remaining sub-fields.

According to the present invention, there is provided a driving apparatus of a plasma display panel comprising a scan electrode and a sustain electrode, comprising a driver driving the scan electrode and the sustain electrode and a driving controller controlling the driver to set a bias voltage applied to the sustain electrode in each address period of one or more low gray level sub-fields of sub-fields constituting a frame, to be less than the bias voltage applied to the sustain electrode in each address period of the remaining sub-fields.

According to the present invention, there is provided a plasma display panel comprising a scan electrode and a sustain electrode, wherein a bias voltage applied to the sustain electrode in each address period of one or more low gray level sub-fields of sub-fields constituting a frame, is set to be less than the bias voltage applied to the sustain electrode in each address period of the remaining sub-fields.

According to the present invention, there is provided a driving method of a plasma display panel comprising a plurality of scan electrodes and sustain electrodes, wherein a bias voltage applied to the sustain electrode in each address period of one or more low gray level sub-fields of sub-fields constituting a frame, is set to be less than the bias voltage applied to the sustain electrode in each address period of the remaining sub-fields.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
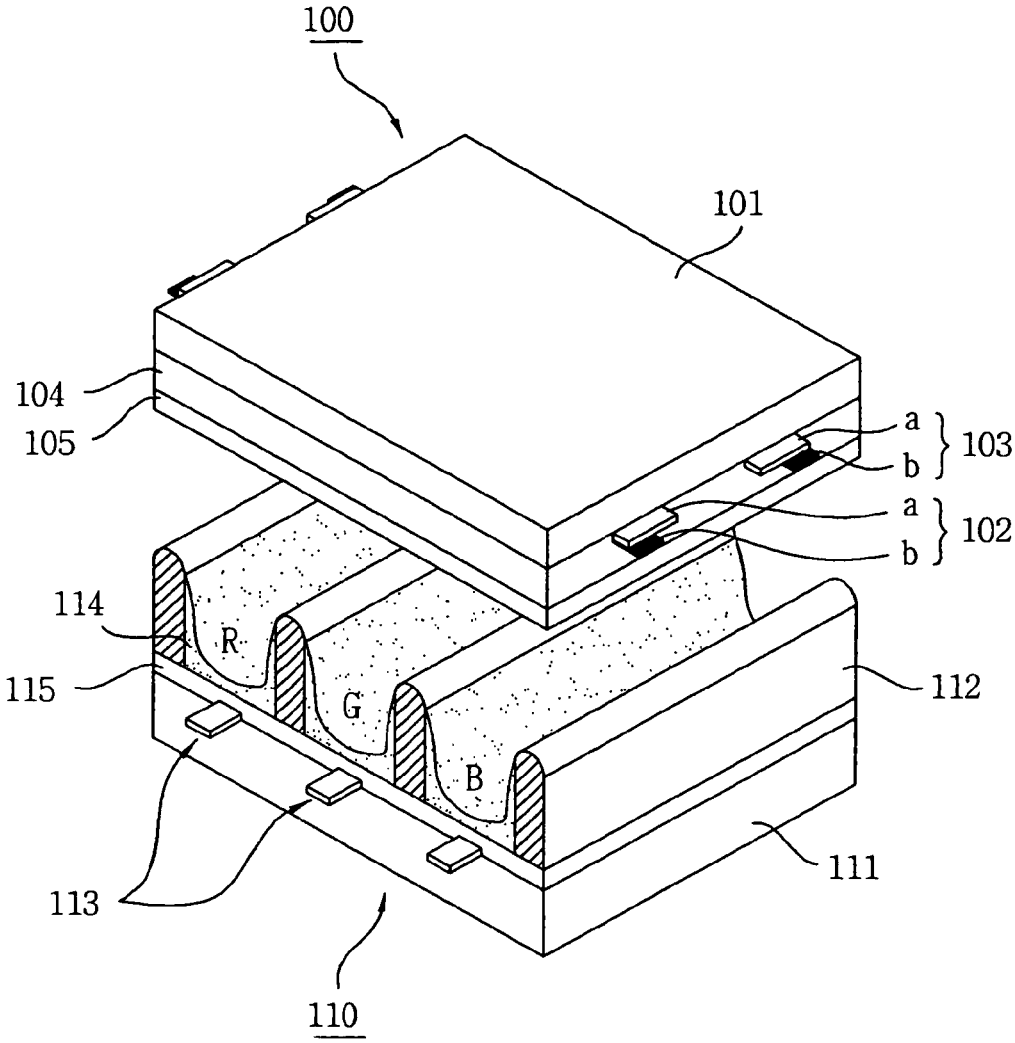
FIG. 1 illustrates the construction of a conventional plasma display panel.
Figure 2:
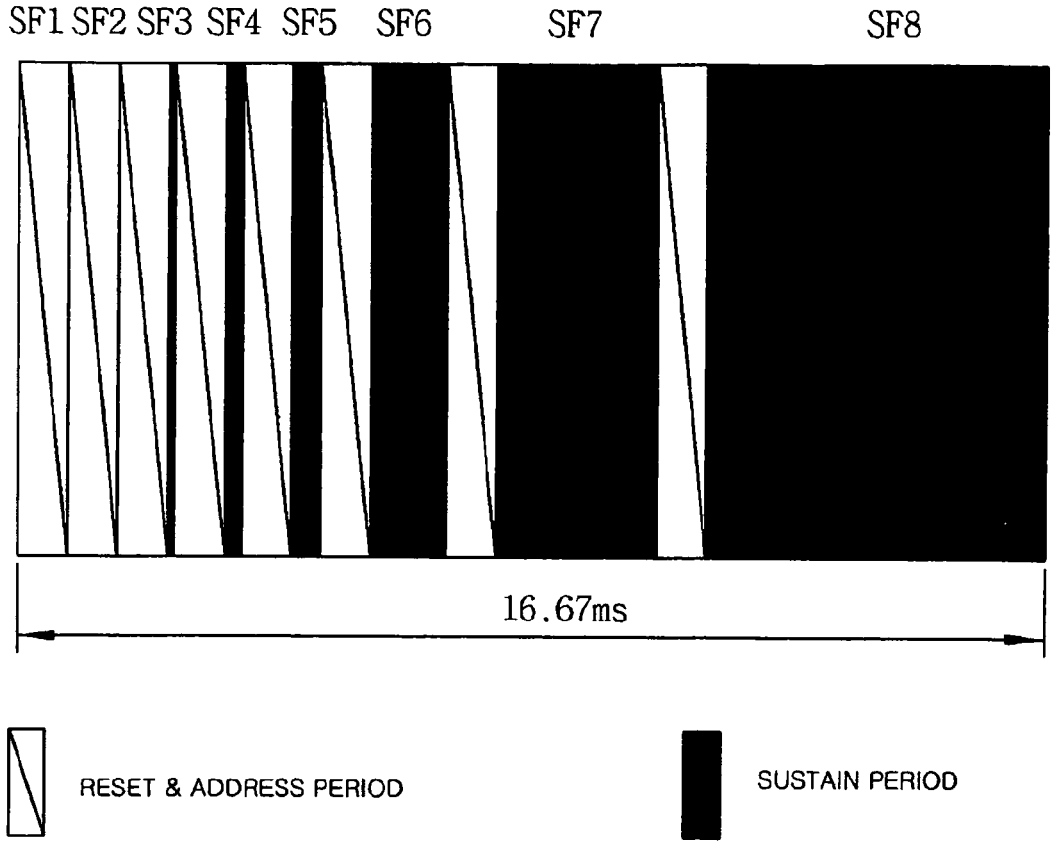
FIG. 2 illustrates a method of implementing image gray levels in the conventional plasma display panel.

A plasma display apparatus according to the present invention comprises a plasma display panel in which a scan electrode and a sustain electrode are formed on a substrate, a scan driver driving the scan electrode, a sustain driver driving the sustain electrode and a sustain pulse controller controlling the scan driver and the sustain driver to set the number of sustain pulses applied to the scan electrode and the sustain electrode in at least one sub-field in a plurality of sub-fields in a frame to an odd number.

The at least one sub-field in which the odd number of sustain pulses may be applied to the scan electrode and the sustain electrode is from a first sub-field which has the lowest brightness weight, to a fourth sub-field.

When a sustain pulse is applied last to either the scan electrode or the sustain electrode, an erase waveform is applied to the scan electrode or the sustain electrode to which the sustain pulse may not be supplied last.

The plurality of sub-fields may comprise a sub-field in which a sustain pulse is not applied.

According to the present invention, there is provided a driving apparatus of a plasma display panel in which a scan electrode and a sustain electrode are formed on a substrate, comprising a scan driver driving the scan electrode, a sustain driver driving the sustain electrode and a sustain pulse controller controlling the scan driver and the sustain driver to set the number of sustain pulses applied to the scan electrode and the sustain electrode in at least one sub-field in a plurality of sub-fields in a frame to an odd number.

According to the present invention, there is provided a plasma display panel in which a scan electrode and a sustain electrode are formed on a substrate, wherein the panel is driven so that the number of sustain pulses applied to the scan electrode and the sustain electrode in at least one sub-field in a plurality of sub-fields in a frame is an odd number.

According to the present invention, there is provided a driving method of a plasma display apparatus displaying an image with a plurality of sub-fields, wherein a number of sustain pulses applied in at least one sub-field of the plurality of sub-fields is an odd number.

A plasma display apparatus according to the present invention comprises a plasma display panel comprising a scan electrode and a sustain electrode, a driver driving the scan electrode and the sustain electrode and a driving controller controlling the driver to set a bias voltage applied to the sustain electrode in an address period of at least one of sub-fields constituting a frame, to be different from the bias voltages which are applied to the sustain electrode in address periods of the remaining sub-fields.

The driving controller may set the bias voltage applied to the sustain electrode in an address period of a low gray level sub-field of the sub-fields to be less than the bias voltages to the sustain electrode in address periods of the remaining sub-fields.

The driving controller may set the bias voltage applied to the sustain electrode in the address period of the low gray level sub-field to be more than a ground level voltage and less than a sustain voltage.

A pair of sustain pulses may be supplied to the scan electrode and the sustain electrode in a sustain period of the low gray level sub-field.

One sustain pulse may be supplied to either the scan electrode or the sustain electrode in the sustain period of the low gray level sub-field.

A sustain pulse may not supplied to the scan electrode and the sustain electrode in the sustain period of the low gray level sub-field.

The driving pulse controller may control a ramp-up pulse to be supplied to the scan electrode and then a ramp-down pulse to be supplied to the scan electrode in a reset period of the low gray level sub-field.

The driving pulse controller may control a positive voltage to remain constant in the scan electrode and then a ramp-down pulse to be supplied to the scan electrodes in a reset period in the low gray level sub-field.

The positive voltage may be a sustain voltage.

The frame may comprise a plurality of low gray sub-fields, and a driving controller may control a ramp-up pulse to be supplied to the scan electrode and then a ramp-down pulse to be supplied to the scan electrode, in a reset period in one or more of the plurality of low gray level sub-fields, and may control a positive voltage to remain constant in the scan electrode and then a ramp-down pulse to be supplied to the scan electrode, in each reset period of the remaining low gray level sub-fields.

The frame may comprise a plurality of low gray sub-fields, and a sustain pulse may not supplied to the scan electrode and the sustain electrode in each sustain period of one or more of the plurality of low gray level sub-fields, and one sustain pulse may be supplied to either the scan electrode or the sustain electrode in each sustain period of the remaining low gray level sub-fields.

The frame may comprise a plurality of low gray sub-fields, and the driving controller may set a bias voltage applied to the sustain electrode in each address period of one or more of the plurality of low gray level sub-fields to be different from the bias voltage applied to the sustain electrode in each address period of the remaining low gray level sub-fields.

The plurality of low gray level sub-fields comprises a first low gray level sub-field and a second low gray level sub-field of which brightness weight may be more than the brightness weight of the first low gray level sub-field, and the driving controller may control a bias voltage applied to the sustain electrode in an address period of the second low gray level sub-field to be more than the bias voltage applied to the sustain electrode in the address period of the first low gray level sub-field.

According to the present invention, there is provided a driving apparatus of a plasma display panel comprising a scan electrode and a sustain electrode, comprising a driver driving the scan electrode and the sustain electrode and a driving controller controlling the driver to set a bias voltage applied to the sustain electrode in each address period of one or more low gray level sub-fields of sub-fields constituting a frame, to be less than the bias voltage applied to the sustain electrode in each address period of the remaining sub-fields.

According to the present invention, there is provided a plasma display panel comprising a scan electrode and a sustain electrode, wherein a bias voltage applied to the sustain electrode in each address period of one or more low gray level sub-fields of sub-fields constituting a frame, is set to be less than the bias voltage applied to the sustain electrode in each address period of the remaining sub-fields.

According to the present invention, there is provided a driving method of a plasma display panel comprising a plurality of scan electrodes and sustain electrodes, wherein a bias voltage applied to the sustain electrode in each address period of one or more low gray level sub-fields of sub-fields constituting a frame, is set to be less than the bias voltage applied to the sustain electrode in each address period of the remaining sub-fields.

The present invention will now be described in detail in connection with preferred embodiments with reference to the accompanying drawings.

Figure 6:
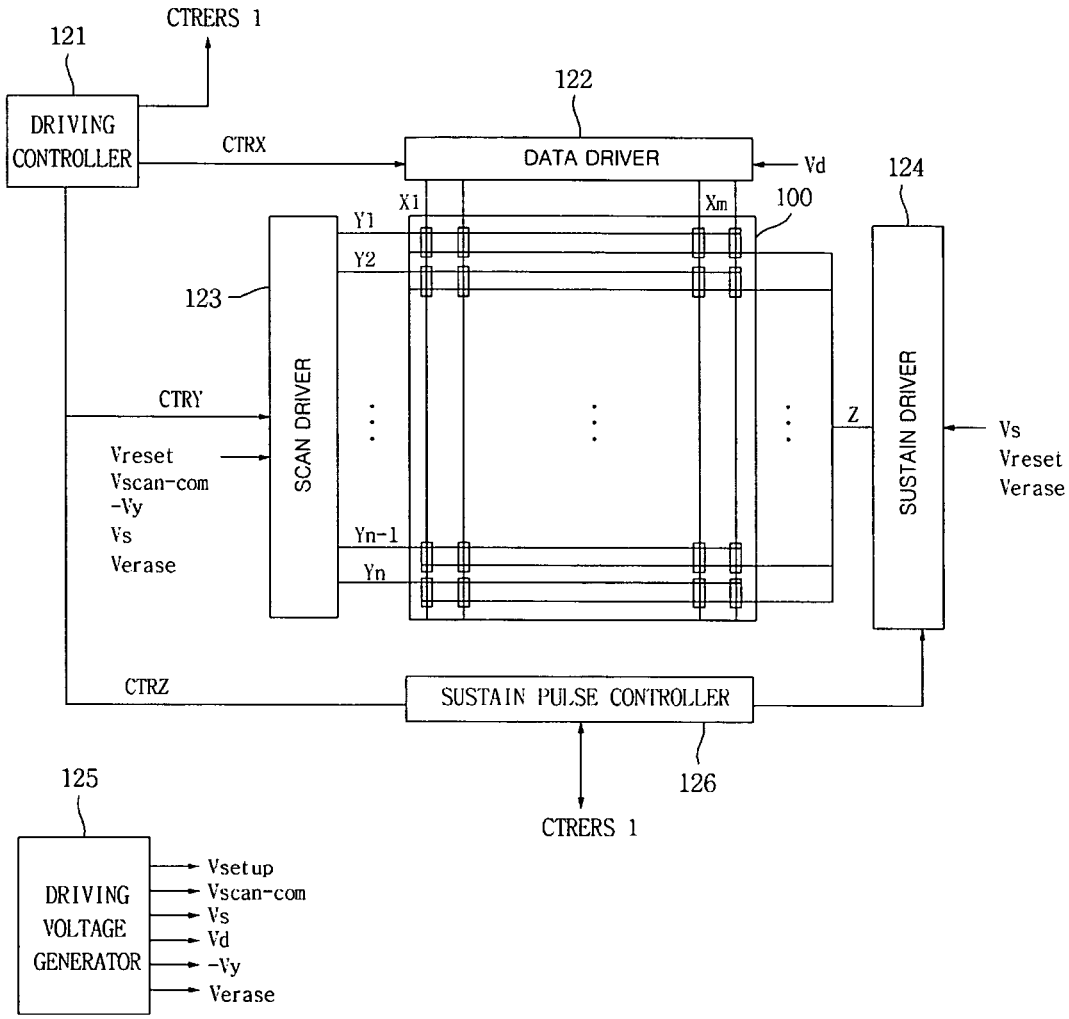
FIG. 6 shows the construction of a plasma display apparatus according to the present invention.

FIG. 6 shows the construction of a plasma display apparatus according to the present invention.

Referring to FIG. 6, the plasma display apparatus according to the present invention comprises a plasma display panel 100 having scan electrodes Y1 to Yn and sustain electrodes Z, and a plurality of address electrodes X1 to Xm intersecting the scan electrodes Y1 to Yn and the sustain electrodes Z, a data driver 122 for supplying data to the address electrodes X1 to Xm formed in a lower substrate (not shown) of the plasma display panel 100, a scan driver 123 for driving the scan electrodes Y1 to Yn, a sustain driver 124 for driving the sustain electrodes Z, i.e., a common electrode, a sustain pulse controller 126 for controlling the number of sustain pulses in a sustain period of each sub-field to increase the implementation of gray levels, a driving controller 121 for controlling the data driver 122, the scan driver 123, the sustain driver 124 and the sustain pulse controller 126 when the plasma display panel is driven, and a driving voltage generator 125 for supplying driving voltages necessary for the drivers 122, 123 and 124.

The plasma display panel 100 comprises an upper substrate (not shown) and a lower substrate (not shown), which are parallel to each other with a predetermined distance therebetween. A number of electrodes, such as the scan electrodes Y1 to Yn and the sustain electrodes Z, are formed in pairs in the upper substrate. The address electrodes X1 to Xm intersecting the scan electrodes Y1 to Yn and the sustain electrodes Z are formed in the lower substrate.

Data supplied to the data driver 122 undergoes inverse gamma correction and error diffusion through an inverse gamma correction circuit (not shown), an error diffusion circuit (not shown) and the like and are then mapped to respective sub-fields by a sub-field mapping circuit (not shown). The data driver 122 samples and latches the data in response to a timing control signal (CTRX) and then supplies the data to the address electrodes X1 to Xm.

The scan driver 123 supplies a ramp-up pulse (Ramp-up) and a ramp-down pulse (Ramp-down) to the scan electrodes Y1 to Yn using a reset voltage (Vreset) during a reset period, and sequentially supplies a scan pulse (Sp) of a scan voltage (−Vy) to the scan electrodes Y1 to Yn during the address period, under the control of the driving controller 121. The scan driver 123 also supplies a common scan voltage (Vscan-com) to the scan electrodes other than a scan electrode on which scanning is performed. The scan driver 123 supplies a sustain pulse (SUS) to the scan electrodes Y1 to Yn while operating alternately with the sustain driver 124 during the sustain period. The scan driver 123 also applies an erase pulse (Verase) to the scan electrodes Y1 to Yn under the control of the driving controller 121.

The sustain driver 124 supplies the ramp-up pulse (Ramp-up) and the ramp-down pulse (Ramp-down) to the sustain electrodes Z1 to Zn using the reset voltage (Vreset) during the reset period under the control of the driving controller 121, supplies a predetermined bias voltage during an address period under the control of the driving controller 121, and supplies the sustain pulse (SUS) to the sustain electrodes Z while operating alternately with the scan driver 123 during the sustain period. The sustain driver 124 supplies the erase pulse (Verase) to the sustain electrodes Z under the control of the driving controller 121.

The sustain pulse controller 126 controls sustain pulses applied in the sustain period depending on a gray level value of data mapped to each sub-field in response to a control signal of the driving controller 121. That is, the sustain pulse controller 126 controls an integral multiple of a pair of the sustain pulses to be alternately applied to the scan electrodes Y1 to Yn or the sustain electrodes Z depending on a brightness brightness weight during a sustain period of a plurality of sub-fields comprised in one frame. The sustain pulse controller 126 according to the present invention controls the scan driver and the sustain driver to set the number of sustain pulses applied to the scan electrode and the sustain electrode in at least one sub-field in a plurality of sub-fields in a frame to an odd number to increase the implementation of the gray levels. The sustain pulse controller 136 can be built in the scan driver 133 or the sustain driver 134.

The driving controller 121 receives vertical/horizontal synchronization signals and a clock signal and generates timing control signals (CTRX, CTRY, CTRZ, CTRERS1) for controlling the operation timing and synchronization of each of the drivers 122, 123 and 124 and the sustain pulse controller 126 in the reset period, the address period and the sustain period. The driving controller 121 applies the timing control signals (CTRX, CTRY, CTRZ, CTRERS1) to corresponding drivers 122, 123 and 124 and the sustain pulse controller 126, thus controlling the drivers 122, 123 and 124 and the sustain pulse controller 126. The driving controller 121 also controls the scan driver 123 or the sustain driver 124 such that the ramp-up pulse (Ramp-up) and the ramp-down pulse (Ramp-down) are supplied to the scan electrodes Y1 to Yn or the sustain electrodes Z during the reset period. The driving controller 121 also controls the sustain driver 124 so that the bias voltage applied to the sustain electrodes Z in the address period is controlled and the controlled bias voltage is applied to the sustain electrodes Z.

That is, the driving controller 121 sets the bias voltage applied to the sustain electrodes Z in the address period of at least one of sub-fields constituting a frame, to be different from the bias voltage which are applied to the sustain electrodes in address periods of the remaining sub-fields. Preferably, the driving controller 121 controls the sustain driver 124 to set the bias voltage applied to the sustain electrodes Z in an address period of a low gray level sub-field of the sub-fields constituting the frame to be less than the bias voltages to the sustain electrode in address periods of the remaining sub-fields. The driving controller 121 controls the scan driver 123 or the sustain driver 124 so that the erase pulse (Verase) is applied to the scan electrodes Y or the sustain electrodes Z. As described above, the driving controller 121 controls the scan driver 123 or the sustain driver 124 such that the ramp-up pulse (Ramp-up) and the ramp-down pulse(Ramp-down) are supplied to the scan electrodes Y1 to Yn or the sustain electrodes Z, if needed. The driving controller 121 also controls the scan driver 123 or the sustain driver 124 so that the erase pulse (Verase) is supplied to an electrode to which the last sustain pulse is not applied when an odd number of sustain pulses is supplied in a sustain period of at least one or more of a plurality of sub-fields to increase the implementation of gray levels.

The data control signal (CTRX) comprises a sampling clock for sampling data, a latch control signal, and a switching control signal for controlling an on/off time of an energy recovery circuit and a driving switch element. The scan control signal (CTRY) comprises a switching control signal for controlling an on/off time of an energy recovery circuit and a driving switch element within the scan driver 123. The sustain control signal (CTRZ) comprises a switching control signal for controlling an on/off time of an energy recovery circuit and a driving switch element within the sustain driver 124.

The driving voltage generator 125 generates the reset voltage (Vreset), the common scan voltage (Vscan-com), the scan voltage (−Vy), the sustain voltage (Vs), the data voltage (Vd) and so on. These driving voltages may be varied depending on the composition of a discharge gas or the construction of a discharge cell.

A driving method of the plasma display apparatus constructed above according to the present invention will be described below in detail.

Embodiment 1

Figure 7:
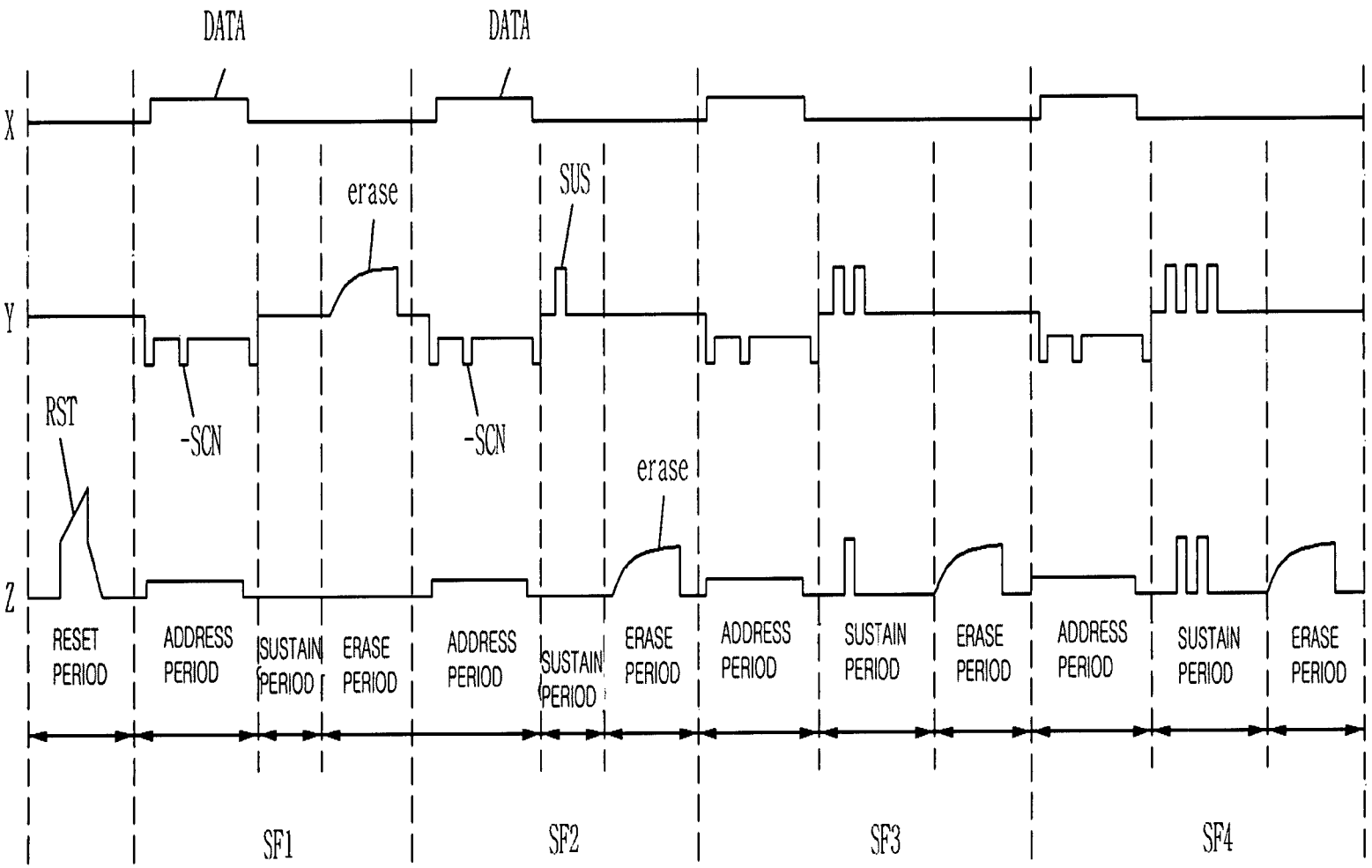
FIG. 7 shows a driving waveform for illustrating a first embodiment of a driving method of a plasma display apparatus according to the present invention.

FIG. 7 shows a driving waveform for illustrating a first embodiment of a driving method of a plasma display apparatus according to the present invention.

Referring to FIG. 7, in the driving method of the plasma display apparatus according to the first embodiment of the present invention, one frame period is time-divided into a plurality of sub-fields SF1, SF2, SF3, SF4, . . . , each comprising a reset period, an address period and a sustain period. Each of the sub-fields has a predetermined brightness brightness weight. This will be described below in more detail.

(First Sub-field)

In the reset period of the first sub-field SF1, a high positive reset pulse or a set-up/set-down pulse (RST) of ramp signal form, which has a predetermined slope, is supplied to the sustain electrodes Z to generate a reset discharge within cells of the entire screen. As wall charges are uniformly accumulated on the cells of the entire screen by the reset discharge, a discharge characteristic becomes uniform.

In the address period, a data pulse (DATA) is supplied to the address electrodes X, and negative scan pulses (−SCN) are sequentially supplied to the scan electrodes Y in synchronization with the data pulse (DATA). As a voltage difference between the scan pulse and the data pulse are added to a wall voltage generated in the reset period, an address discharge is generated within cells to which the data pulse is applied.

In the sustain period, the sustain pulse is not applied to the scan electrodes Y or the sustain electrodes Z.

In the erase period, the erase pulse (erase) is applied to the scan electrodes Y.

(Second Sub-field)

The address period of the second sub-field SF2 is the same as the address period of the first sub-field SF1. In the sustain period, one sustain pulse (SUS) is applied to either the scan electrodes Y or the sustain electrodes Z, as shown in FIG. 7. When the sustain pulse (SUS) is supplied to either the scan electrodes Y or the sustain electrodes Z in the sustain period, in the erase period, an erase pulse (erase), which has a ramp waveform, is applied to the scan electrodes Y or the sustain electrodes Z to which the sustain pulse is not supplied.

(Third Sub-field)

The address period of the third sub-field SF3 is the same as the address period of the first sub-field SF1. The sustain pulse (SUS) can be alternately applied to the scan electrodes Y and the sustain electrodes Z in the sustain period. A number of sustain pulses applied to the scan electrodes Y and the sustain electrode Z increases as a brightness weight of a sub-field increases to implement high gray levels. In this case, the last sustain pulse is supplied to either the scan electrodes(Y) or the sustain electrodes(Z) in order that a total number of sustain pulses applied in the sustain period may be an odd number.

In the erase period, when the last sustain pulse (SUS) that is applied during a previous sustain period is applied to either the scan electrodes Y or the sustain electrodes Z, the erase pulse (erase), which has a ramp waveform, is supplied to the scan electrodes Y or the sustain electrodes Z to which the last sustain pulse (SUS) is not supplied.

(Fourth Sub-field)

The address period of the fourth sub-field SF4 is the same as the address period of the first sub-field SF1. In the sustain period, as in the third sub-field, an odd number of the sustain pulses are applied to the scan electrodes Y and the sustain electrodes Z.

The erase period of the fourth sub-field is also the same as the erase period of the third sub-field SF3. Description thereof will be omitted.

(Fifth, Sixth, Seventh, . . . Sub-fields)

Though not shown in the drawing, the address period of each of the fifth, sixth, seventh, . . . sub-fields SF5, SF6, SF7, . . . is the same as the address period of the first sub-field SF1. In the sustain period, the sustain pulse can be supplied alternately to the scan electrodes Y and the sustain electrode Z. The odd number of the sustain pulses can be supplied to the scan electrodes Y and the sustain electrode Z as in the fourth sub-field SF4. In the erase period, the erase pulse (erase) is supplied to the sustain electrode Z. In the driving method of the plasma display apparatus according to the first embodiment of the present invention, at least one sub-field in a plurality of sub-fields in a frame, in which the odd number of sustain pulses are applied to the scan electrode and the sustain electrode, is from a first sub-field which has the lowest brightness weight, to a fourth sub-field. An odd number of the sustain pulses can be supplied only in any one of the sub-fields.

In the driving method of the plasma display apparatus according to the first embodiment of the present invention, if an odd number of the sustain pulses are applied in the low gray level sub-fields SF1 to SF4 having low brightness weights, the amount of light generated by the odd number of the sustain pulses can be controlled finely. Therefore the implementation of gray levels improves. If the odd number of the sustain pulses are applied in any one of all of the sub-fields, the amount of light generated by the sustain pulse can be controlled finely. Therefore the implementation of gray levels improves.

The odd number of the sustain pulses can be supplied only in the lowest low gray level sub-field to increase the implementation of gray levels. And the implementation of gray levels can be increased through various methods by applying an odd number of sustain pulses in the sustain period in any sub-field having any brightness weight.

Embodiment 2

Figure 8:
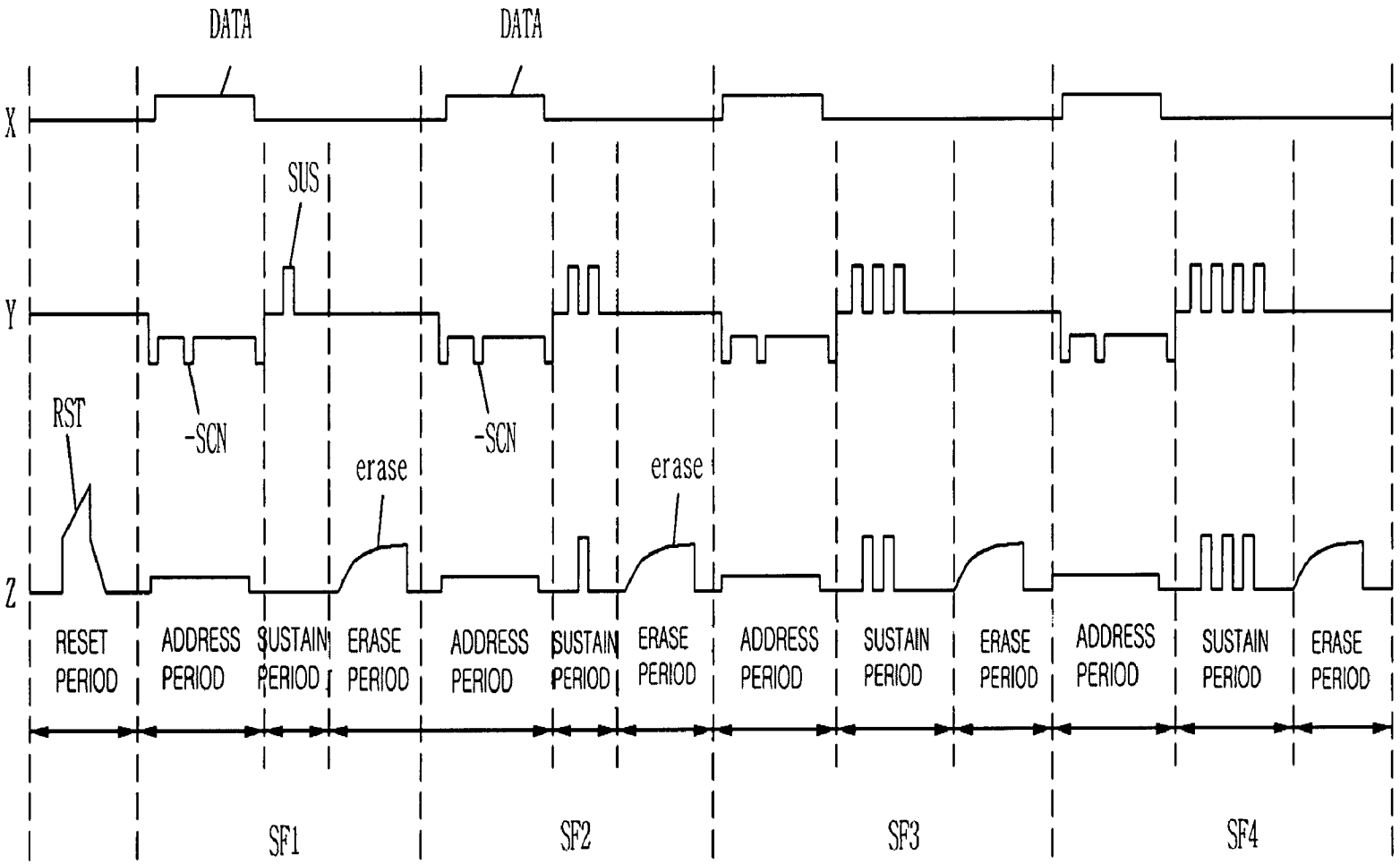
FIG. 8 shows a driving waveform for illustrating a second embodiment of a driving method of a plasma display apparatus according to the present invention.

FIG. 8 shows a driving waveform for illustrating a second embodiment of a driving method of a plasma display apparatus according to the present invention. Referring to FIG. 8, in the driving method of the plasma display apparatus according to the second embodiment of the present invention, one frame period is time-divided into a plurality of sub-fields SF1, SF2, SF3, SF4, . . . , each comprising a reset period, an address period and a sustain period, as in FIG. 7. Each of the sub-fields is set to have a predetermined brightness brightness weight. This will be described below in more detail.

(First Sub-field)

In the reset period of the first sub-field SF1, a positive reset pulse or a set-up/set-down pulse (RST) of a ramp waveform, which has a predetermined slope, is supplied to the sustain electrodes Z to generate a reset discharge within cells of the entire screen. As wall charges are uniformly accumulated on the cells of the entire screen by the reset discharge, a discharge characteristic becomes uniform.

In the address period, a data pulse (DATA) is supplied to the address electrodes X, and negative scan pulses (−SCN) are sequentially supplied to the scan electrodes Y in synchronization with the data pulse (DATA). As a voltage difference between the scan pulse and the data pulse are added to a wall voltage generated in the reset period, an address discharge is generated within cells to which the data pulse is applied.

In the sustain period, one sustain pulse (SUS) is supplied to either the scan electrodes Y or the sustain electrodes Z.

In the erase period, when the one sustain pulse (SUS) is supplied to either the scan electrodes Y or the sustain electrode Z in the sustain period, the erase pulse (erase) which has a ramp waveform, is supplied to the scan electrodes Y or the sustain electrodes Z to which the one sustain pulse is not supplied.

(Second Sub-field)

The address period of the second sub-field SF2 is the same as the address period of the first sub-field SF1. In the sustain period, the sustain pulses (SUS) are alternately supplied to the scan electrodes Y and the sustain electrodes Z. A number of sustain pulses applied to the scan electrodes Y and the sustain electrode Z increases as a brightness weight increases to implement high gray levels. In this case, the last sustain pulse is supplied to either the scan electrodes or the sustain electrode so that a total number of sustain pulses applied in the sustain period is an odd number.

In the erase period, when the last sustain pulse (SUS) is supplied to either the scan electrodes Y or the sustain electrode Z during a sustain period, the erase pulse (erase), which has a ramp waveform, is supplied to the scan electrodes Y or the sustain electrodes Z to which the last sustain pulse (SUS) is not supplied.

(Third and Fourth Sub-fields)

The address period of each of the third and fourth sub-fields SF3 and SF4 is the same as the address period of the first sub-field SF1. In the sustain period, the odd number of the sustain pulses (SUS) are supplied to the scan electrodes Y and the sustain electrode Z as in the second sub-field SF2.

The erase period is also the same as the erase period of the third sub-field SF3. Description thereof will be omitted.

(Fifth, Sixth, Seventh, . . . Sub-fields)

Though not shown in the drawing, the address period of each of the fifth, sixth, seventh, . . . sub-fields SF5, SF6, SF7, . . . is the same as the address period of the first sub-field SF1. In the sustain period, the sustain pulse can be supplied to the scan electrodes Y and the sustain electrode Z, and the odd number of the sustain pulses are supplied to the scan electrodes Y and the sustain electrode Z as in the third and fourth sub-fields SF3 and SF4. In the erase period, the erase pulse (erase) is supplied to the sustain electrode Z.

In the driving method of the plasma display apparatus according to the first embodiment of the present invention, a sustain pulse is not supplied to the scan electrodes and the sustain electrodes in the first sub-field. In the driving method of the plasma display apparatus according to the second embodiment of the present invention, a sustain pulse is supplied to either the scan electrodes or the sustain electrodes in the first sub-field. However, in the driving method of the plasma display apparatus according to the second embodiment of the present invention, the implementation of gray levels can be enhanced since the odd number of the sustain pulses are applied. in the low gray level sub-fields SF1 to SF4 having low brightness weights and the amount of light generated by the sustain pulses can be finely controlled, as in the first embodiment.

Figure 9:
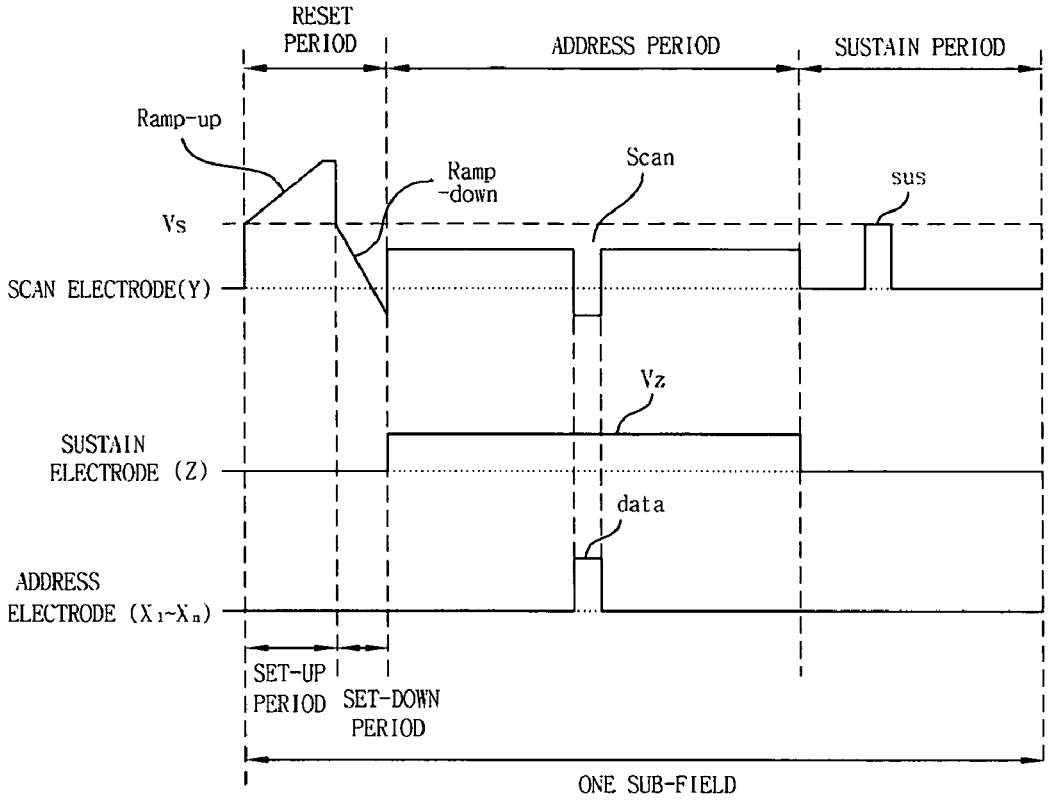
FIG. 9 shows a driving waveform for illustrating improved picture quality of the driving method of the plasma display apparatus according to the present invention.
Figure 10:
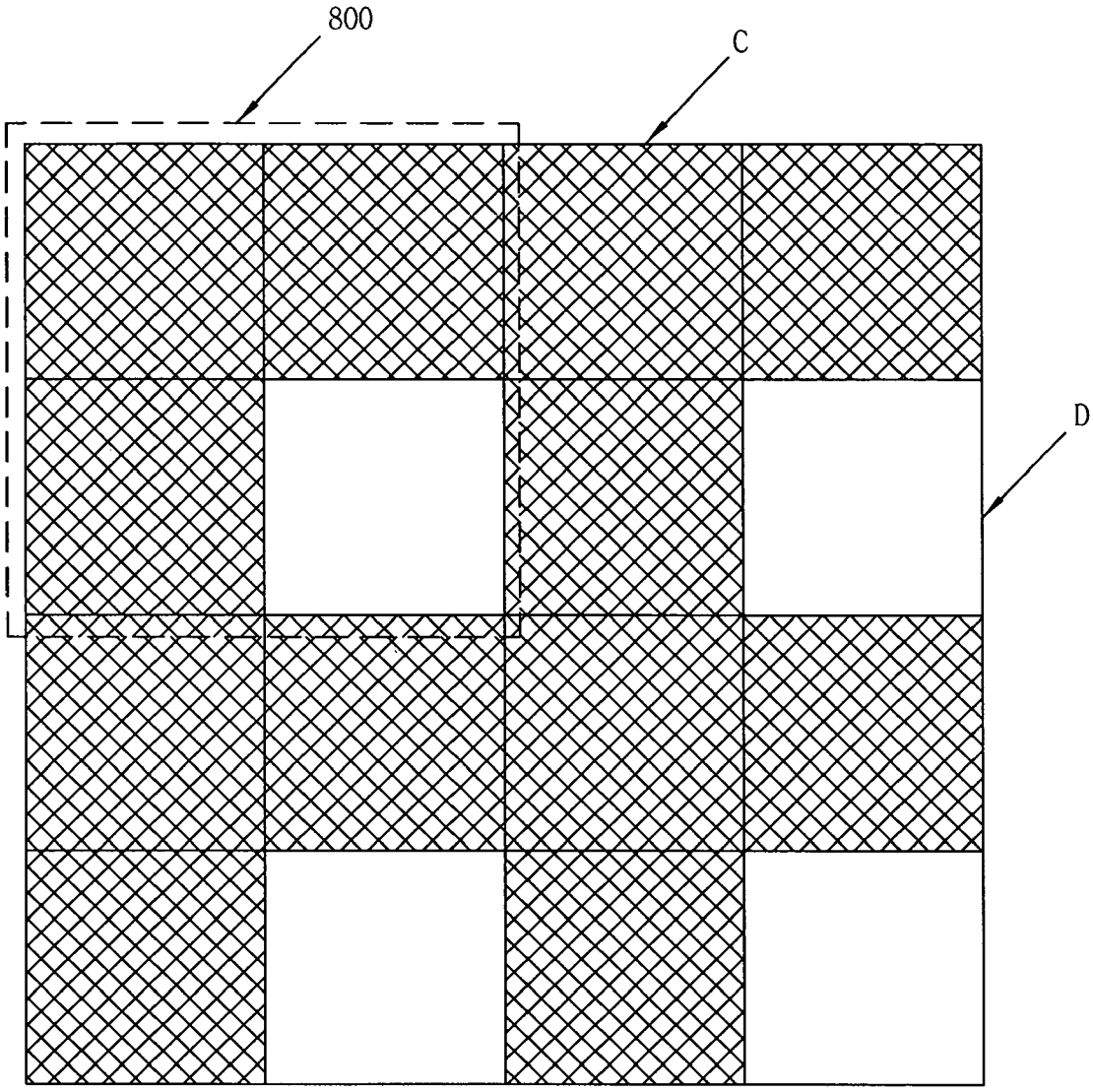
FIG. 10 illustrates an example of a method of implementing low gray levels of 1 or less using the driving waveform shown in FIG. 9.

FIG. 9 shows a driving waveform for illustrating improved picture quality of the driving method of the plasma display apparatus according to the present invention. FIG. 10 illustrates an example of a method of implementing low gray levels of 1 or less using the driving waveform shown in FIG. 9. As shown in FIG. 9, to further improve the picture quality in the low gray levels according to the driving method according to the present invention, the number of sustain pulses supplied in the sustain period is set to one.

Accordingly, assuming that the light implemented by the driving waveform of FIG. 9 is the light implementing a gray level 1 as shown in FIG. 10, where a gray level of 0.25 is to be implemented in a region consisting of a total of 16 discharge cells on a plasma display panel, the gray level of 0.25 is generally implemented by controlling the number of discharge cells C that are turned off and discharge cells D that are turned on. The reason why the light implemented by the driving waveform of FIG. 9 is the light implementing the gray level 1 is that one sustain pulse implements the gray level 1 for the convenience of this discussion. That is, in the driving waveform of FIG. 9, a total of one gray level is implemented since one sustain pulse is supplied.

In FIG. 10, one discharge cell that is turned on implements the light implementing a gray level of 1. Where a gray level of 0.25 is to be implemented in a region comprising a total of 16 discharge cells on a plasma display panel as in FIG. 10, the gray level of 0.25 is generally implemented by controlling the number of discharge cells C that are turned off and discharge cells D that are turned on. For example, as in a region of reference numeral 800, if three discharge cells is turned off and one discharge cell is turned on in a region 800 comprising four discharge cells, the light generated in the region 800 becomes the light for implementing the gray level 1. Accordingly, each discharge cell of the region 800 implements the gray level of 0.25. In the driving method according to the present invention, finer low gray levels can be implemented and half-tone noise decreases since a difference in the brightness between the discharge cells that are turned on and discharge cells that are turned off is relatively small, compared to the conventional method shown in FIG. 5.

Embodiment 3

Figure 11:
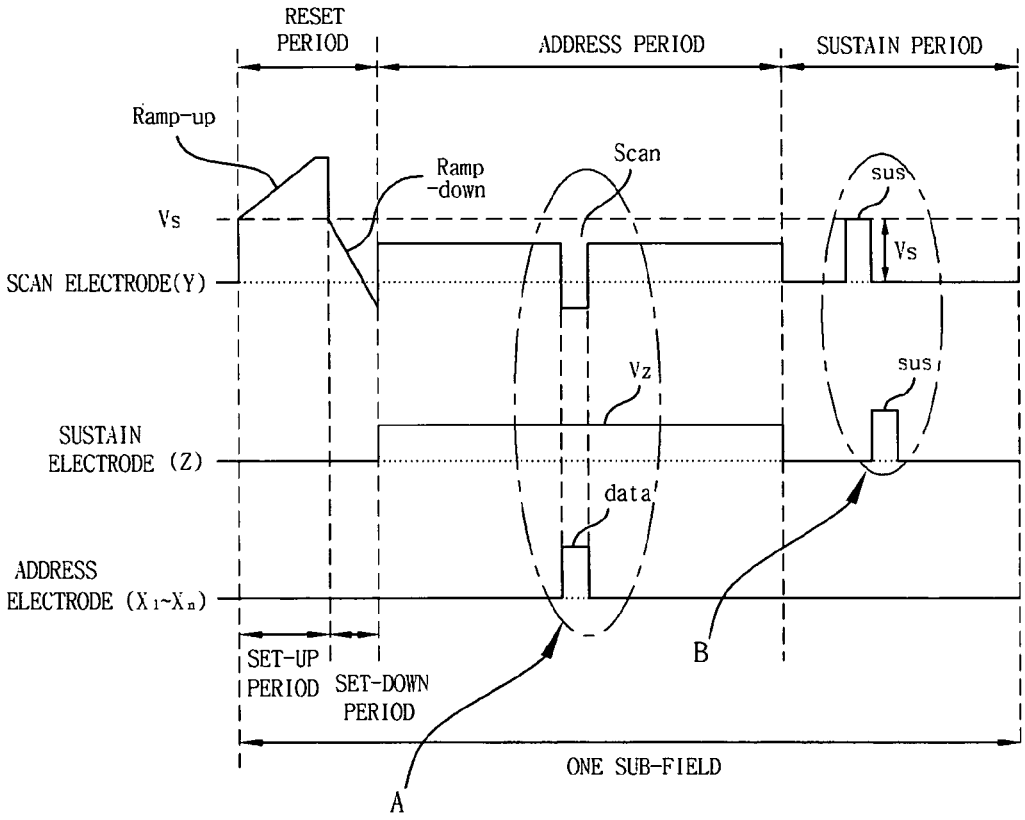
FIG. 11 shows a driving waveform for illustrating a third embodiment of a driving method of a plasma display apparatus according to the present invention.

FIG. 11 shows a driving waveform for illustrating a third embodiment of a driving method of a plasma display apparatus according to the present invention. Referring to FIG. 11, in the driving method of the plasma display apparatus according to the third embodiment of the present invention, a bias voltage applied to the sustain electrode Z in the address period in a low gray level sub-field of total sub-fields in a frame is less than the bias voltages in the remaining sub-fields. Preferably, the bias voltage is more than a ground level voltage (GND), but less than a sustain voltage (Vs). The aforementioned low gray level sub-field is preferably a sub-field in which a pair of sustain pulses are supplied to the scan electrodes Y and the sustain electrode Z in the sustain period, of sub-fields of a frame. This low gray level sub-field is not limited to the sub-field in which the pair of sustain pulses is supplied in the sustain period, as shown FIG. 11, but an odd number of sustain pulses can be supplied in the sustain period of the low gray level sub-field. Description thereof will be given in more detail in the following embodiments.

In FIG. 1, the lowest gray level is implemented so that the number of sustain pulses supplied in the sustain period is 2 and a positive bias voltage (Vz) applied to the sustain electrode Z in the address period is less than the bias voltages of the remaining sub-fields. For example, while the bias voltage (Vz) applied to the sustain electrode Z in the address period is less than the bias voltages of the remaining sub-fields, a number of sustain pulses supplied to the scan electrodes Y is set to "1" and a number of sustain pulses supplied to the sustain electrode Z is also set to "1".

If the bias voltage (Vz) applied to the sustain electrode Z in the address period is set to be less than the bias voltages of the remaining sub-fields as described above, an address discharge that is generated between a scan pulse supplied to the scan electrodes Y and a data pulse supplied to the address electrodes X during the address period weakens. The address discharge weakens because the number of wall charges participating in an address discharge, which is generated between the scan electrodes and the address electrodes, decreases by reducing a difference in a voltage between a scan pulse applied to the scan electrodes and a sustain pulse applied to the sustain electrodes at a point of time when the address discharge is generated in the address period. Accordingly, the amount of light generated in the address period decreases.

Since the address discharge generating in the address period is weak, the amount of wall charges accumulated within discharge cells decreases. The amount of light generated by a sustain pulse in a subsequent sustain period also decreases. As a result, by reducing the amount of the bias voltage (Vz) applied to the sustain electrodes in the address period, the amount of light generated by one lowest gray level sub-field can be reduced further compared to the case of FIG. 3 in the related art.

A discharge that may affect the implementation of the gray levels in the case of FIG. 11 is the address discharge generated in the address period and the sustain discharge generated in the sustain period. Light generated by this discharge is radiated outwardly to implement the gray levels. That is, the gray levels in the driving waveform as shown in FIG. 11 are determined by the light generated by an address discharge and a sustain discharge. As described above, a discharge influencing gray levels will be described in conjunction with FIG. 11.

Figure 12:
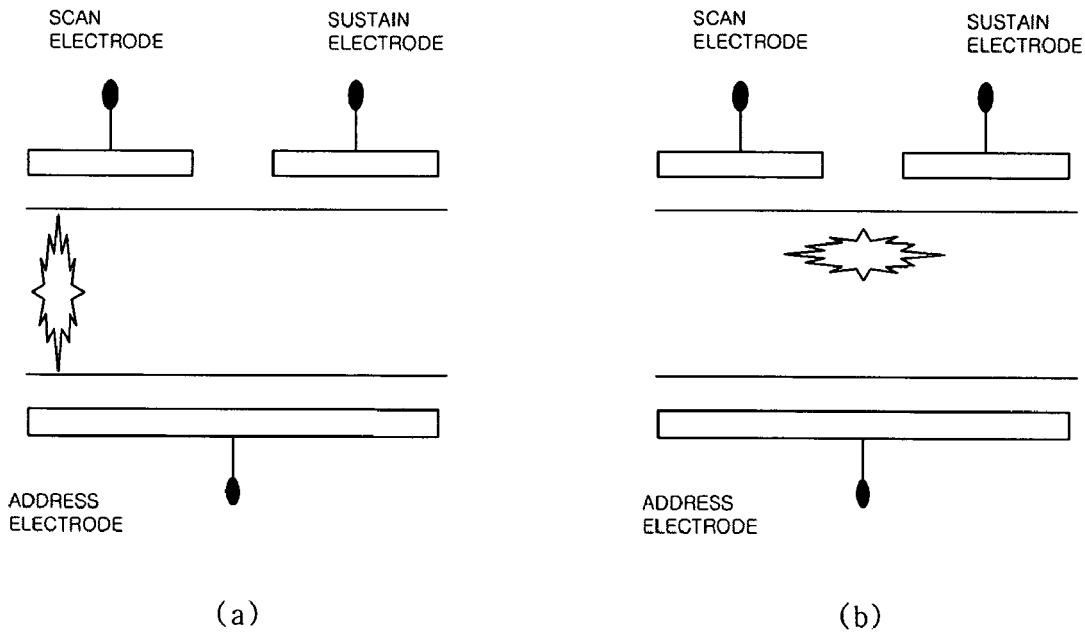
FIG. 12 illustrates a discharge affecting the implementation of gray levels in the driving waveform shown in FIG. 11.

FIG. 12 illustrates a discharge affecting the implementation of gray levels in the driving waveform shown in FIG. 11.

Figure 4:
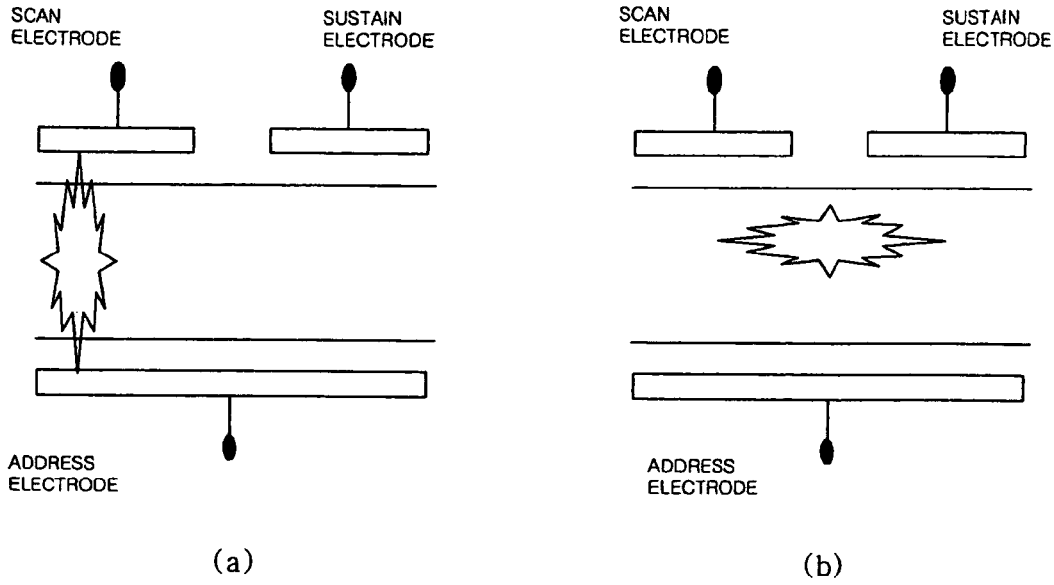
FIG. 4 illustrates a discharge affecting the implementation of gray levels in the driving waveform shown in FIG. 3.

Referring to FIG. 12, in a region A of the driving waveform shown in FIG. 11, an address discharge is generated between the scan electrodes Y and the address electrodes X in the address period. In a region B of the driving waveform shown in FIG. 11, a sustain discharge is generated between the scan electrodes Y and the sustain electrode Z in the sustain period. When comparing FIG. 12 with the conventional FIG. 4, it can be seen that the intensity of the address discharge generated between the scan electrodes Y and the address electrodes X and the sustain discharge generated between the scan electrodes Y and the sustain electrode Z weakens. In the driving waveform of FIG. 11, a discharge is generated by a reset discharge in the reset period, but the reset discharge is generated within all of the discharge cells on the plasma display panel. Therefore, the light generated by the reset discharge does not influence the implementation of the gray levels.

The reason why the intensity of the address discharge and the sustain discharge weakens as in FIG. 12, compared to the prior art, is that the bias voltage (Vz) applied to the sustain electrode in the address period has decreased. Such a bias voltage (Vz) will now be described in more detail with reference to FIG. 13.

Figure 13:
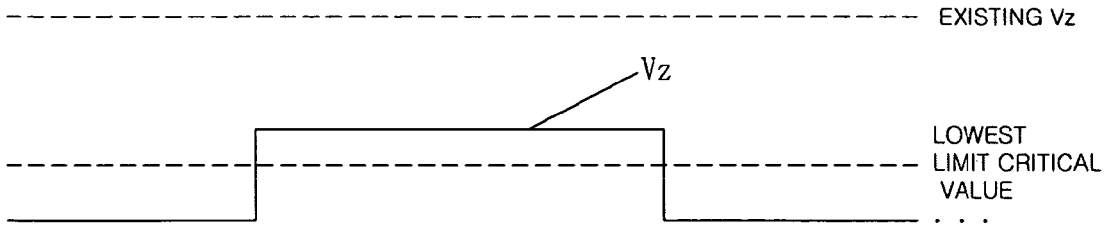
FIG. 13 illustrates, in more detail, a bias voltage (Vz) applied to sustain electrodes in an address period in the driving waveform shown in FIG. 11.

FIG. 13 illustrates, in more detail, a bias voltage (Vz) applied to sustain electrodes in an address period in the driving waveform shown in FIG. 11.

Referring to FIG. 13, in the driving method according to the present invention, the bias voltage (Vz) applied to the sustain electrode Z in the address period is less than an existing bias voltage (Vz). The lowest critical value is a value that prevents a wall voltage between the scan electrodes Y and the address electrodes X in the address period from becoming less than an address discharge firing voltage necessary for an address discharge. This is because if the bias voltage (Vz) applied to the sustain electrode Z in the address period becomes too low in the present invention, wall charges accumulated between the scan electrodes Y and the address electrodes X decreased and an address discharge is not generated accordingly. To be more specific, the bias voltage (Vz) applied to the sustain electrode Z in the address period is more than the ground level voltage(GND), but less than the sustain voltage (Vs).

The reset period in the above-mentioned low gray level sub-field will be described. As in FIG. 11, a ramp-up pulse can be supplied to the scan electrodes in a set-up period, and a ramp-down pulse can be supplied to the scan electrodes in a set-down period.

However, to reduce the amount of the light generated in the above-described low gray level sub-field, preferably, the ramp-up pulse in the reset pulse is omitted. For example, in a reset period of a low gray level sub-field, a positive voltage remains constant in the scan electrodes in a set-up period and a ramp-down pulse is supplied to the scan electrodes in a set-down period. The positive voltage is the sustain voltage (Vs) of FIG. 11.

If a ramp-up pulse is omitted in a reset pulse of a low gray level sub-field as described above, the amount of light generated in the low gray level sub-field can be further decreased and the implementation of a low gray level is further increased.

An example of a method of implementing a low gray level of 1 or less, i.e., a decimal gray level using the driving waveform of FIG. 11 will be described below with reference to FIG. 14.

Figure 14:
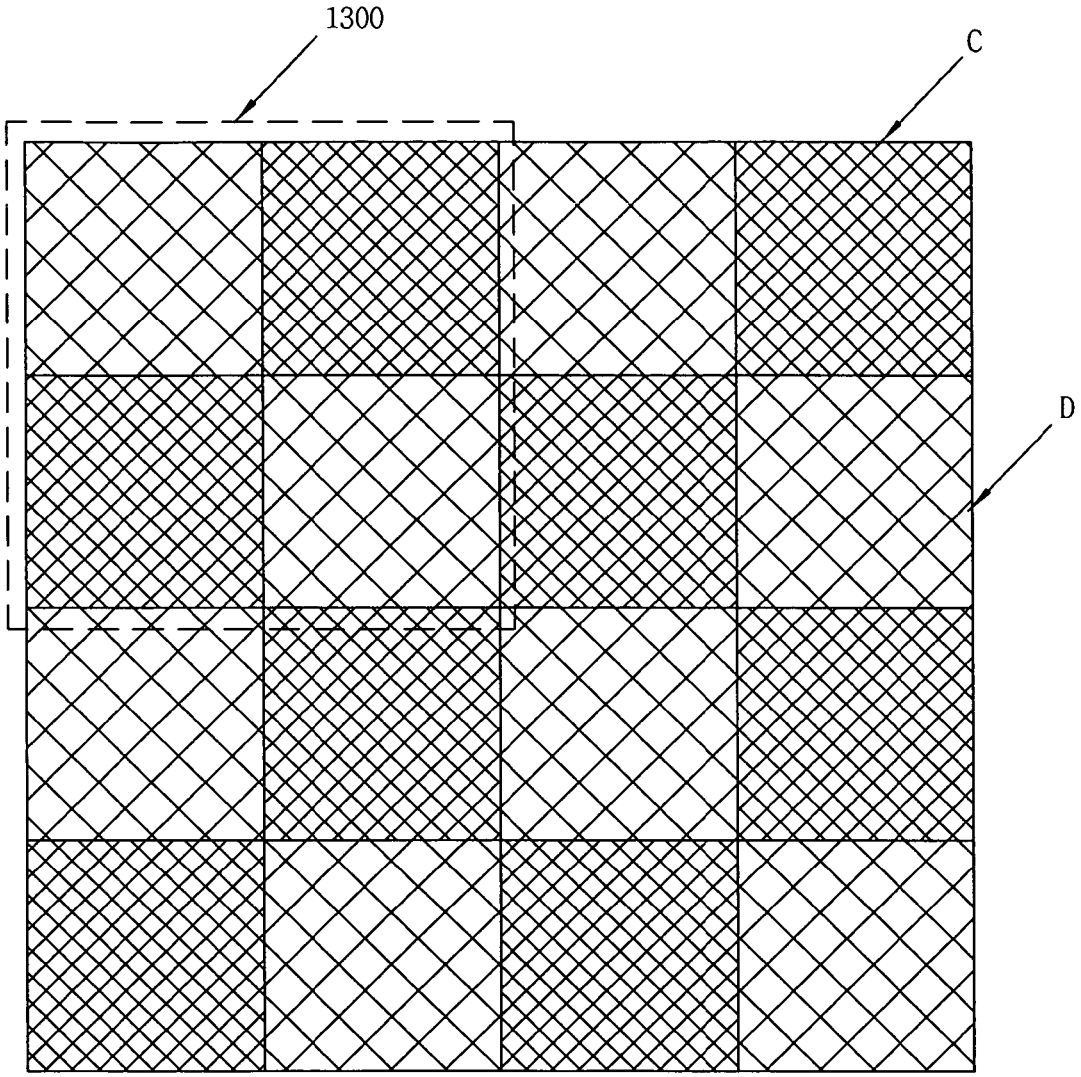
FIG. 14 illustrates a method of implementing an example of a method of implementing a decimal low gray level of 1 or less in the driving waveform shown in FIG. 11.

FIG. 14 illustrates a method of implementing an example of a method of implementing a decimal low gray level of 1 or less in the driving waveform shown in FIG. 11.

Figure 3:
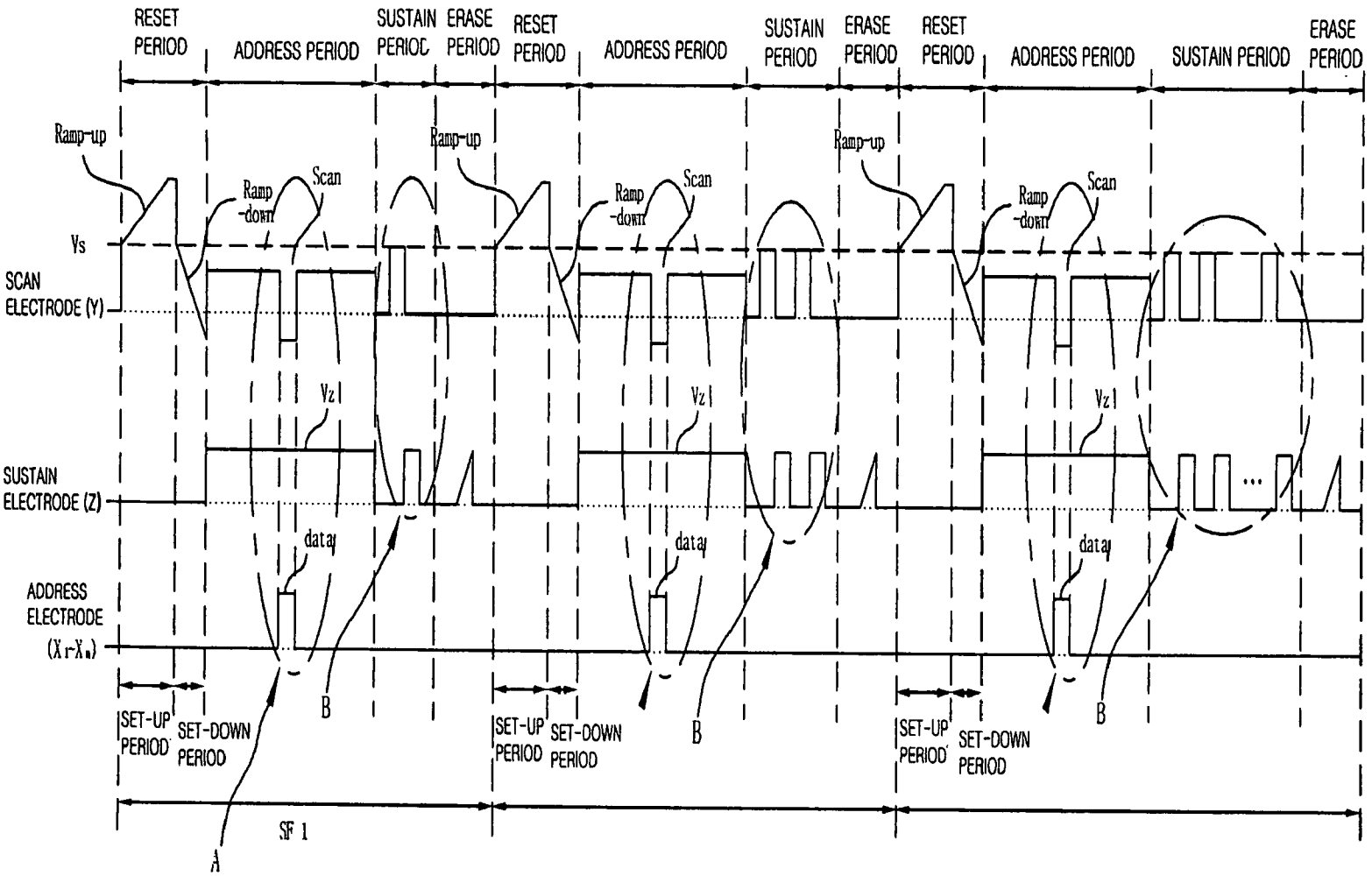
FIG. 3 shows a driving waveform depending on the driving method of the conventional plasma display panel.
Figure 5:
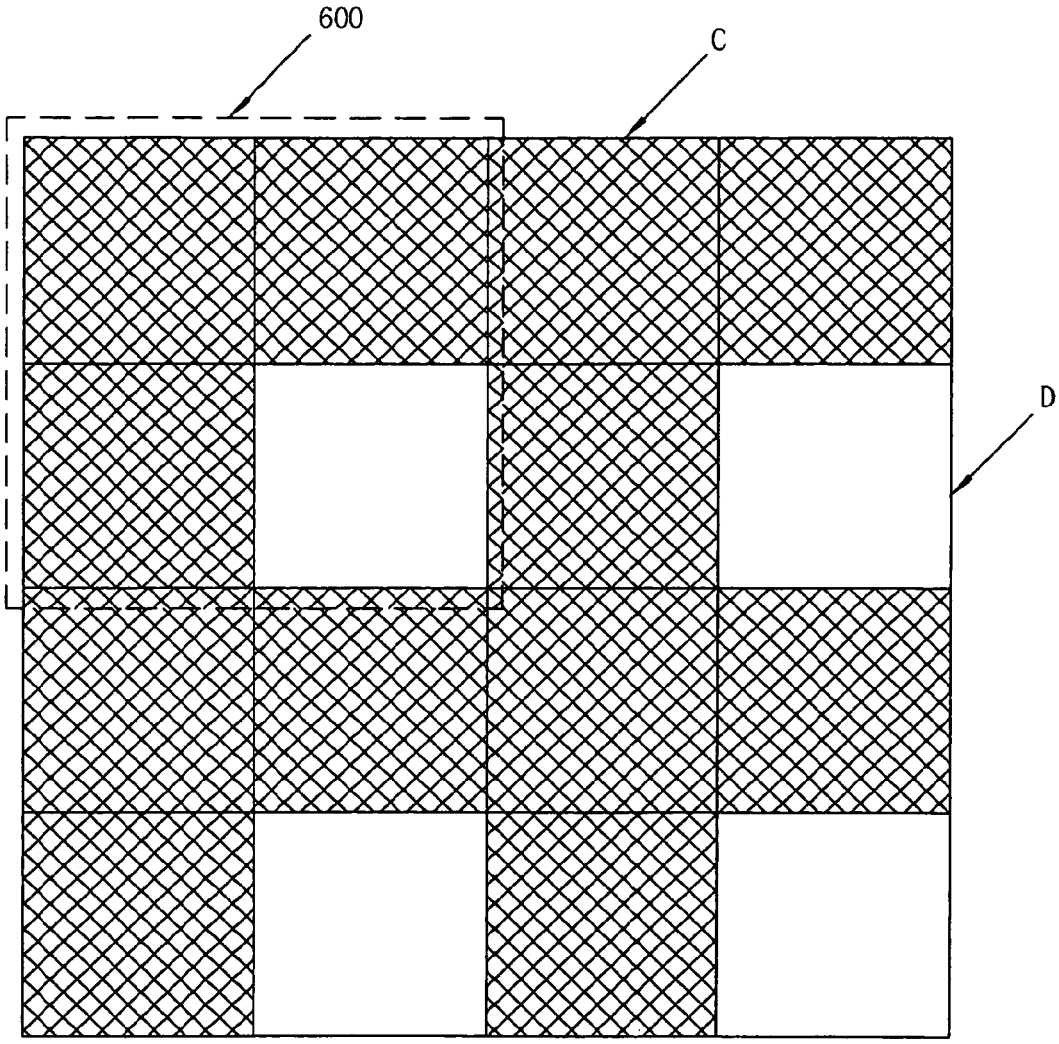
FIG. 5 illustrates an example of a method of implementing low gray levels of 1 or less in the driving waveform shown in FIG. 3.

Referring to FIG. 14, since the address discharge and the sustain discharge by the driving waveform of the invention shown in FIG. 11 are weakly generated compared to the address discharge and the sustain discharge by the conventional driving waveform shown in FIG. 3, the amount of light generated by the discharge cells, shown in FIG. 14, that are turned on by the driving waveform of FIG. 11 is less than the amount of light generated by the discharge cells, shown in FIG. 5, that are turned on by the driving waveform of FIG. 3. For example, assuming that one discharge cell in FIG. 5 generates the light implementing a gray level of 2, one discharge cell that is turned on in FIG. 14 generates the light implementing the gray levels which is less than "2".

In FIG. 14, one discharge cell that is turned on generates the light implementing a gray level of 1. Where a gray level of 0.5 is to be implemented in a region having a total of 16 discharge cells on a plasma display panel as in FIG. 5, the gray level of 0.5 is generally implemented by controlling the number of the discharge cells C that are turned off and the discharge cells D that are turned on.

For example, the total light, which is generated from a region 1300 having four discharge cells as shown in a region 1300 by turning off two discharge cells and turning on two discharge cells in the region, becomes the light for implementing a gray level of 2. Accordingly, each of the discharge cells of the region 1300 implements a gray level of 0.5. If this pattern of FIG. 13 is compared with FIG. 5, the same gray level of 0.5 can be implemented using further divided patterns.

That is, a difference in the brightness between the discharge cells that are turned on and the discharge cells that are turned off decreases and the size of a unit region on a plasma display panel, for performing half-tone for implementing a predetermined decimal gray level, decreases. Therefore, it is possible to implement a finer picture quality. Also, the generation of half-tone noise, such as the spreading of the picture quality at boundary portions of images, decreases.

A method of decreasing the bias voltage (Vz) applied to the sustain electrodes in the address period and setting the number of sustain pulses supplied in the sustain period to be an odd number, to further improve the picture quality in a low gray level, will be described below in connection with a driving method of the plasma display apparatus according to a fourth embodiment of the present invention.

Embodiment 4

Figure 15:
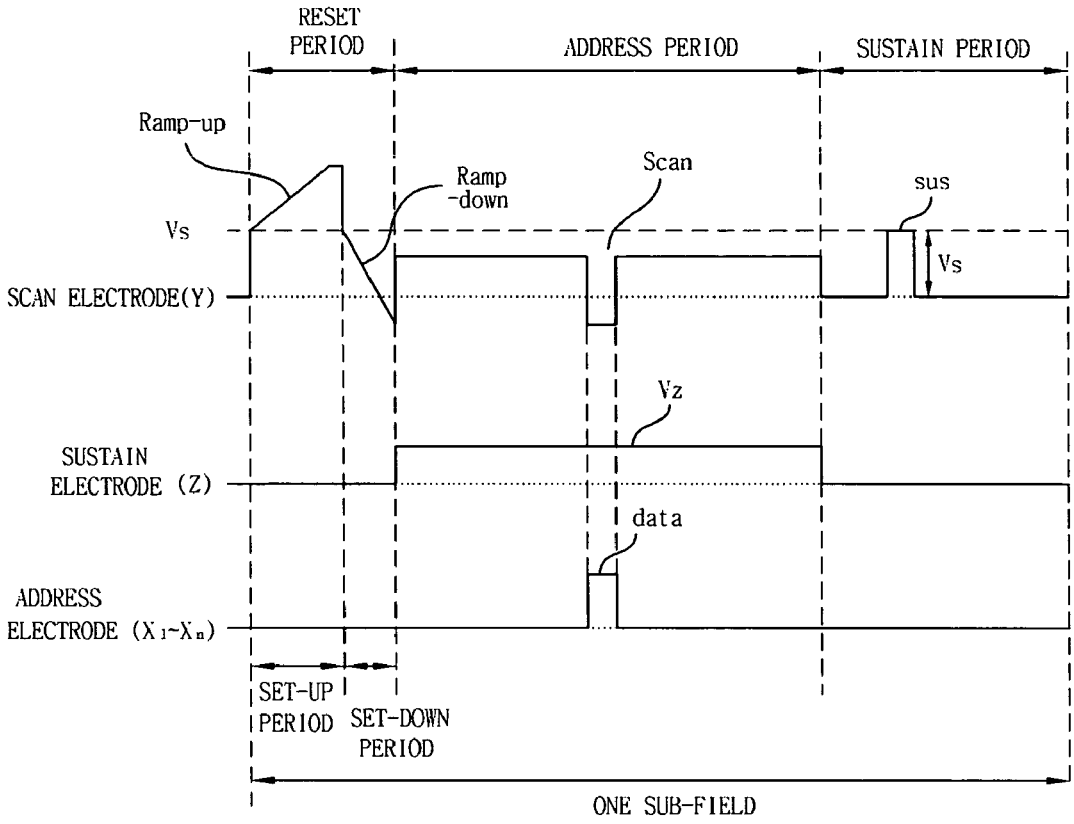
FIG. 15 shows a driving waveform for illustrating a fourth embodiment of a driving method of a plasma display apparatus according to the present invention.

FIG. 15 shows a driving waveform for illustrating a fourth embodiment of a driving method of a plasma display apparatus according to the present invention. Referring to FIG. 15, in the driving method of the plasma display apparatus according to the fourth embodiment of the present invention, a bias voltage applied to the sustain electrode Z in the address period in a low gray level sub-field of the sub-fields of a frame is less than the bias voltages of the remaining sub-fields. The bias voltage can be more than the ground level voltage(GND), but less than the sustain voltage (Vs). In the third embodiment of the present invention, in a sustain period of a low gray level sub-field, an integral multiple of a pair of sustain pulses are supplied to the scan electrodes Y and the sustain electrodes Z. However, in the fourth embodiment of the present invention, an odd number of sustain pulses are supplied to the scan electrodes Y and the sustain electrodes Z. In the sustain period of the low gray level sub-field, one sustain pulse can be supplied to any one of the scan electrodes Y and the sustain electrode Z.

In FIG. 15, the lowest gray level is implemented so that the number of sustain pulses supplied in the sustain period is set to "1" and a positive bias voltage (Vz) applied to the sustain electrode Z in the address period is less than the bias voltage of the remaining sub-fields. For example, while the bias voltage applied to the sustain electrode Z in the address period is set to be less than the bias voltages of the remaining sub-fields, a number of the sustain pulse supplied to the scan electrodes Y is set to 1. Any sustain pulses are not supplied to the sustain electrode Z.

If the number of sustain pulses supplied in the sustain period is set to 1 as described above, the amount of light generated in the sustain period can be decreased in comparison to the first embodiment of the above-mentioned driving method.

An example of a method of implementing a low gray level of 1 or less, i.e., a decimal gray level using the driving waveform of FIG. 15 will be described below with reference to FIG. 16.

Figure 16:
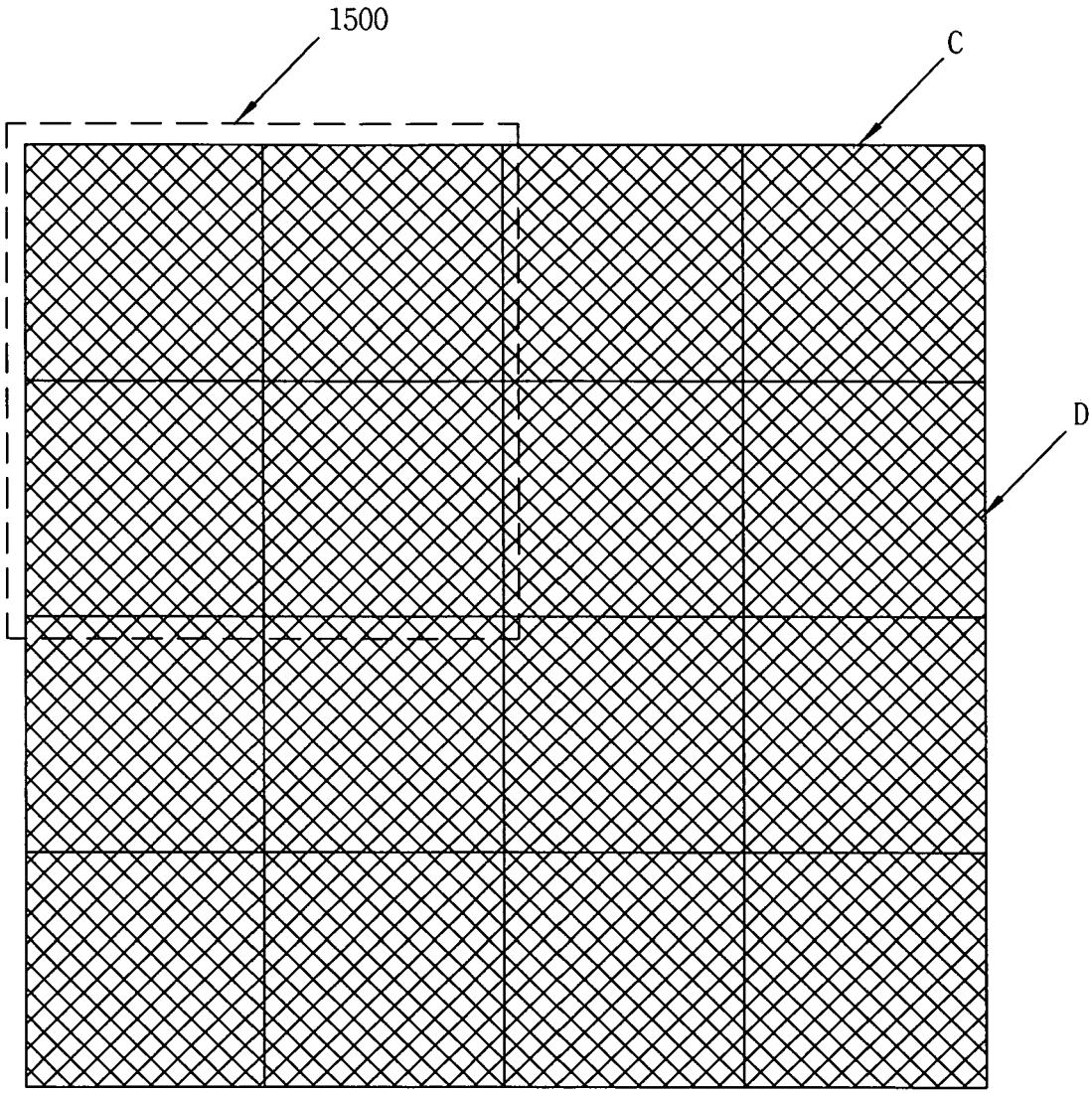
FIG. 16 illustrates an example of a method of implementing a decimal low gray level of 1 or less in the driving waveform shown in FIG. 15.

FIG. 16 illustrates a method of implementing a decimal low gray level of 1 or less in the driving waveform shown in FIG. 15.

Referring to FIG. 16, since the address discharge and the sustain discharge are weakly generated compared to the third embodiment of FIG. 14, the amount of light generated by the discharge cells that are turned on by the driving waveform of FIG. 15 is less than the amount of light of the third embodiment. For example, assuming that one discharge cell in FIG. 14 generates the light implementing a gray level of 1, the one discharge cell that is turned on in FIG. 16 generates the light implementing a gray level which is less than "1".

It is assumed that one discharge cell that is turned on in FIG. 16 generates the light implementing a gray level of 0.5. Where a gray level of 0.25 is to be implemented in a region having a total of 16 discharge cells on a plasma display panel as shown in FIG. 15, the gray level of 0.25 is generally implemented by controlling the number of discharge cells C that are turned off and the discharge cells D that are turned on.

For example, the total light, which is generated from a region 1500 having four discharge cells as shown in a region 1500 by turning off two discharge cells and turning on two discharge cells in the region, becomes the light for implementing a gray level of 1. Accordingly, each of the discharge cells of the region 1500 implements a gray level of 0.25. If this pattern of FIG. 15 is compared with FIG. 8, the same gray level of 0.25 can be implemented using further divided patterns.

That is, a difference in the brightness between the discharge cells that are turned on and the discharge cells that are turned off decreases and the size of a unit region on a plasma display apparatus, for performing half-tone for implementing a predetermined decimal gray level, decreases. The half-tone noise, such as the spreading of the picture quality at boundary portions of images, also decreases. Therefore it is possible to implement a finer picture quality.

A method of decreasing the bias voltage (Vz) applied to the sustain electrodes in the address period and not supplying sustain pulses supplied in the sustain period, to further improve the picture quality in a low gray level, will be described below in connection with a driving method of the plasma display apparatus according to a fifth embodiment of the present invention.

Embodiment 5

Figure 17:
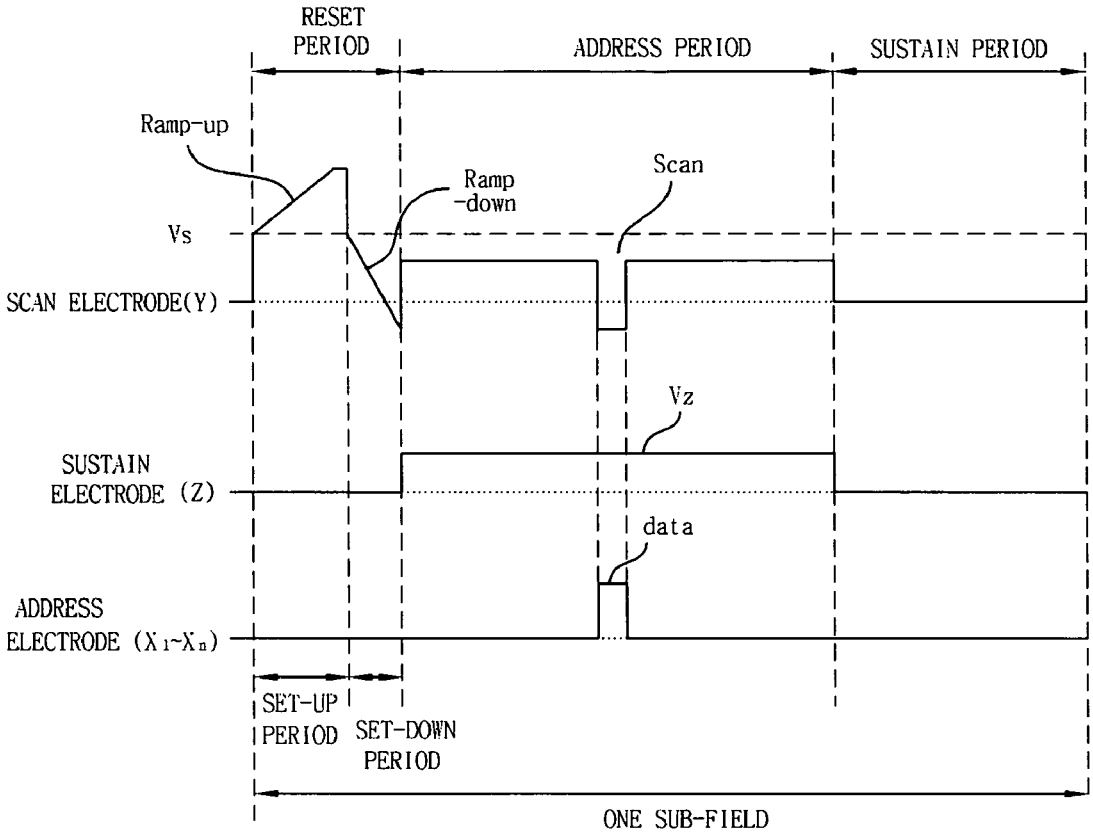
FIG. 17 shows a driving waveform for illustrating a fifth embodiment of a driving method of a plasma display apparatus according to the present invention.

FIG. 17 shows a driving waveform for illustrating a fifth embodiment of a driving method of a plasma display apparatus according to the present invention.

Referring to. FIG. 17, in the driving method of the plasma display apparatus according to the fifth embodiment of the present invention, a bias voltage applied to the sustain electrode Z in the address period in a low gray level sub-field of the sub-fields of a frame is less than the bias voltage of the remaining sub-fields. The bias voltage can be more than the ground level (GND), but less than the sustain voltage (Vs). Unlike the driving method of the plasma display apparatus according to the first and second embodiments of the present invention, a low gray level sub-field is a sub-field in which a sustain pulse is not supplied to any one of the scan electrodes Y and the sustain electrode Z in a sustain period of sub-fields of a frame.

In FIG. 17, the lowest gray level is implemented by preventing the supply of the sustain pulse in the sustain period and setting the positive bias voltage (Vz) applied to the sustain electrode Z in the address period less than the bias voltage of the remaining sub-fields. For example, while the bias voltage applied to the sustain electrode Z in the address period is set to be less than the bias voltages of other sub-fields, the sustain pulse is not supplied to the scan electrodes Y and the sustain electrode Z.

If the supply of the sustain pulse in the sustain period is prevented, as described above, the amount of light generated in the sustain period decreases in comparison to the third and fourth embodiments of the above-mentioned driving method.

Figure 18:
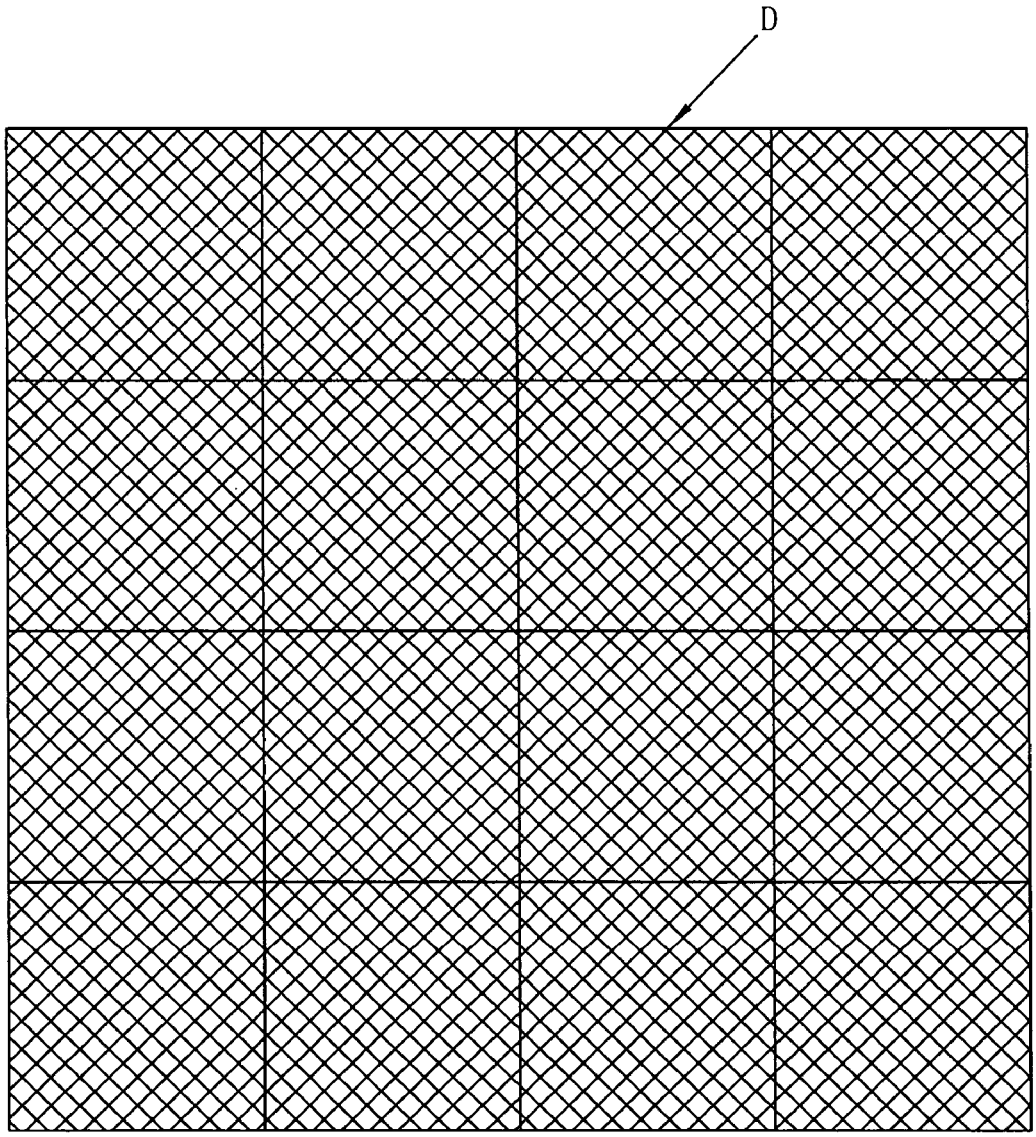
FIG. 18 illustrates a method of implementing an example of a method of implementing a decimal low gray level of 1 or less in the driving waveform shown in FIG. 17.

FIG. 18 illustrates a method of implementing an example of a method of implementing a decimal low gray level of 1 or less in the driving waveform shown in FIG. 17.

Referring to FIG. 18, since the address discharge and the sustain discharge are weakly generated compared to the fourth embodiment of FIG. 16, the amount of light generated by the discharge cells that are turned on by the driving waveform of FIG. 18 is less than that of the fourth embodiment of FIG. 16. For instance, assuming that one discharge cell in FIG. 16 generates light implementing a gray level of 0.5, one discharge cell that is turned on in FIG. 18 generates light implementing a gray level which is less than "0.5".

It is assumed that one discharge cell that is turned on in FIG. 18 implements the light implementing a gray level of 0.25. Where a gray level of 0.25 is to be implemented in a region having a total of 16 discharge cells on a plasma display panel as in FIG. 16, if the entire discharge cells are turned on, the gray level of 0.25 can be implemented in the region having a total of 16 discharge cells. When comparing this pattern of FIG. 18 with the pattern of FIG. 16 for implementing the same gray level of 0.25, half-tone noise is not generated since THE discharge cells that are turned off do not exist.

To further improve the implementation of gray levels in a low gray level, a sub-field where the bias voltage (Vz) applied to the sustain electrode in the address period is reduced can be plural within one frame. This will be described in connection with a driving method of the plasma display panel according to a sixth embodiment of the present invention.

Embodiment 6

Figure 19:
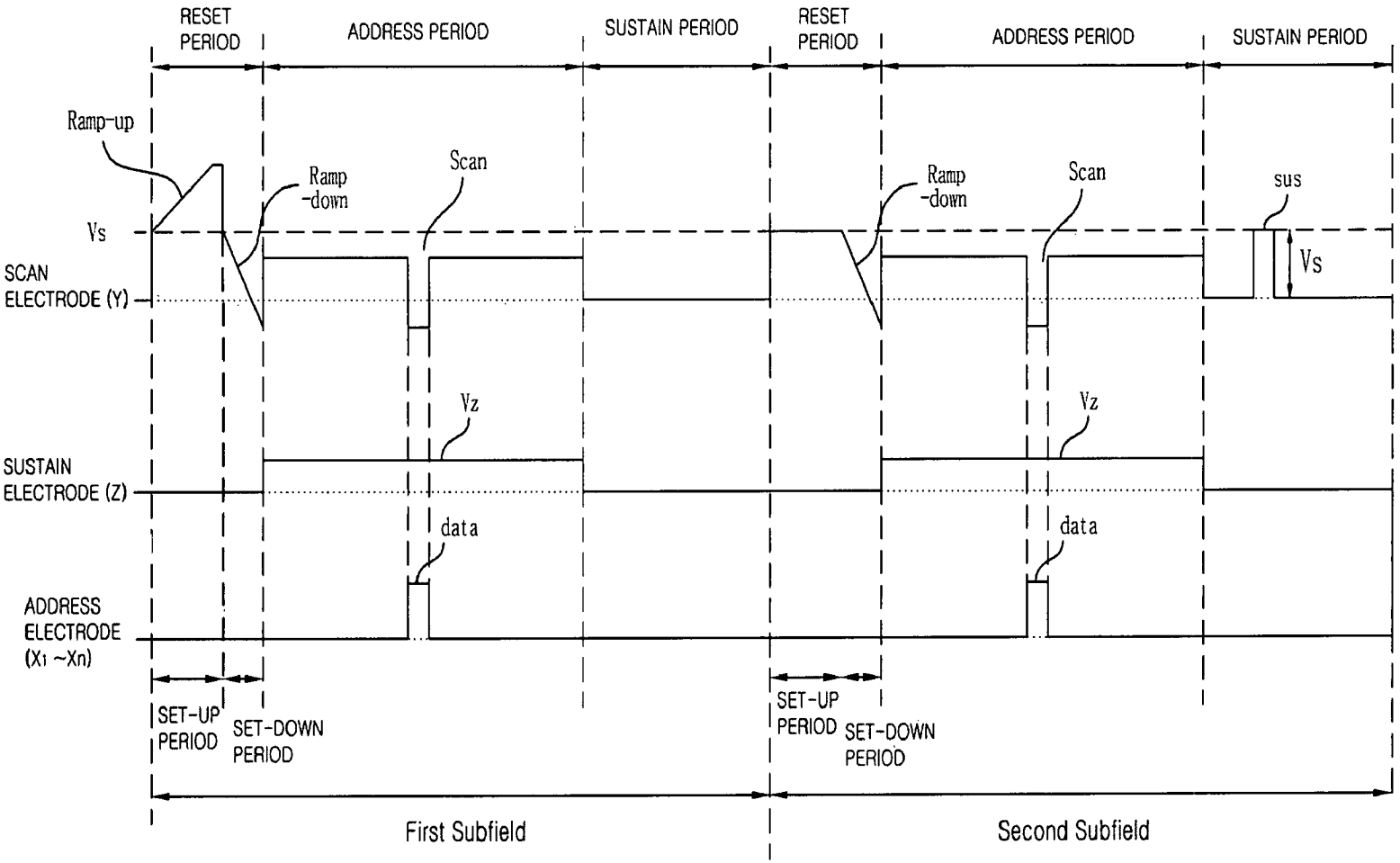
FIG. 19 shows a driving waveform for illustrating a sixth embodiment of a driving method of a plasma display apparatus according to the present invention.

FIG. 19 shows a driving waveform for illustrating a sixth embodiment of a driving method of a plasma display apparatus according to the present invention.

Referring to FIG. 19, in the driving method of the plasma display apparatus according to the sixth embodiment of the present invention, a bias voltage applied to the sustain electrode Z in the address period in a low gray level sub-field of sub-fields of a frame is less than the bias voltage of the remaining sub-fields. The bias voltage can be more than the ground level voltage(GND), but less than the sustain voltage (Vs). Unlike the driving method of the plasma display apparatus according to the third, fourth and fifth embodiments of the present invention, a low gray level sub-field is plural within one frame.

That is, in the third, fourth and fifth embodiments, a case where one low gray level sub-field is comprised in one frame has been shown and described. In the sixth embodiment, however, a low gray level sub-field within one frame is plural. In this case, one or more of the above-mentioned plurality of low gray level sub-fields are sub-fields in which a sustain pulse is not supplied to the scan electrodes Y and the sustain electrode Z in the sustain period, and the remaining low gray level sub-fields are sub-fields in which one sustain pulse is supplied to any one of the scan electrodes Y and the sustain electrode Z in the sustain period.

For example, as shown in FIG. 19, two low gray level sub-fields are comprised in one frame. One of the plurality of low gray level sub-fields, i.e., the first sub-field is a sub-field in which the sustain pulse is not supplied to the scan electrodes Y and the sustain electrode Z in the sustain period Z, and the remaining low gray level sub-fields, i.e., the second sub-field is a sub-field in which one sustain pulse is supplied to any one of the scan electrodes Y and the sustain electrode Z in the sustain period.

Where a plurality of low gray level sub-fields is comprised in one frame as described above, the picture quality in a low gray level can be further improved when implementing images.

If a plurality of low gray level sub-fields is comprised in one frame as described above, a bias voltage applied to the sustain electrode Z in the address period in one or more of the plurality of low gray level sub-fields can be different from the bias voltage of the remaining low gray level sub-fields. For example, as shown in FIG. 19, when the number of low gray level sub-fields is two, i.e., a first sub-field and a second sub-field are the low gray level sub-fields, a bias voltage applied to the sustain electrode Z in an address period of the first sub-field and a bias voltage applied to the sustain electrode Z in an address period of the second sub-field are different from each other.

Preferably, a bias voltage applied to the sustain electrode Z in an address period of a second low gray level sub-field whose brightness weight is more than a first low gray level sub-field, of the plurality of low gray level sub-fields, is more than the bias voltages of the first low gray level sub-field. For example, when the first sub-field and the second sub-field are low gray level sub-fields as in FIG. 19, a bias voltage applied to the sustain electrode Z in an address period of the first sub-field whose brightness weight is less than the second sub-field is less than the bias voltage of the second sub-field.

The reason why a bias voltage applied to the sustain electrode in an address period of a low gray level sub-field whose brightness weight is less than the remaining gray level sub-fields, of a plurality of low gray level sub-fields, is less than those of the remaining gray level sub-fields, as described above, is to further enhance the implementation of a low gray level by weakening an address discharge in a low gray level sub-field whose brightness weight is low, of a plurality of low gray level sub-fields.

Where a plurality of low gray level sub-fields are comprised in one frame, a ramp-up pulse is supplied to a scan electrodes Y in a set-up period of a reset period and a ramp-down pulse is supplied to the scan electrodes Y in a set-down period of the reset period, in one or more of the plurality of low gray level sub-fields. In the remaining low gray level sub-fields, a positive voltage remains constant in the scan electrodes Y in the set-up period of the reset period, and a ramp-down pulse is supplied to in the scan electrodes Y in the set-down period of the reset period. In this case, the above-described positive voltage can be the sustain voltage (Vs).

For example, where the first sub-field and the second sub-field are low gray level sub-fields as shown in FIG. 19, a ramp-up pulse is supplied to the scan electrodes Y in a set-up period and a ramp-down pulse is supplied to the scan electrodes Y in a set-down period, in a reset period of the first sub-field. In a reset period of the second sub-field, a positive voltage remains constant in the scan electrodes Y in the set-up period and the ramp-down pulse is supplied to the scan electrodes Y in the set-down period.

As described above, according to the present invention, at least one or more sub-fields in which an odd number of sustain pulses is supplied in a sustain period of a plurality of sub-fields are provided. Accordingly, a finer gray level is implemented and the picture quality is improved.

According to the present invention, half-tone noise when implementing a low gray level can decrease by controlling the amount of a bias voltage applied to a sustain electrode. Therefore, it is possible to improve the picture quality.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is clamed is:

1. A plasma display apparatus, comprising:

a plasma display panel in which a scan electrode and a sustain electrode are formed on a substrate;

a scan driver driving the scan electrode;

a sustain driver driving the sustain electrode; and a sustain pulse controller controlling the scan driver and the sustain driver to set the number of sustain pulses applied to the scan electrode and the sustain electrode in at least one sub-field in a plurality of sub-fields in a frame to an odd number, wherein the plurality of sub-fields comprises at least one sub-field having an address period in which a bias voltage is applied to the sustain electrode and a sustain period in which a sustain pulse is not applied to the scan and sustain electrodes.

2. The plasma display apparatus as claimed in claim 1, wherein the at least one sub-field in which the odd number of sustain pulses are applied to the scan electrode and the sustain electrode is from a first sub-field which has the lowest brightness weight, to a fourth sub-field.

3. The plasma display apparatus as claimed in claim 1, wherein when a sustain pulse is applied last to either the scan electrode or the sustain electrode, an erase pulse is applied to the scan electrode or the sustain electrode to which the sustain pulse is not supplied last.

4. A driving apparatus of a plasma display panel in which a scan electrode and a sustain electrode are formed on a substrate, comprising:

a scan driver driving the scan electrode;

a sustain driver driving the sustain electrode; and a sustain pulse controller controlling the scan driver and the sustain driver to set the number of sustain pulses applied to the scan electrode and the sustain electrode in at least one sub-field in a plurality of sub-fields in a frame to an odd number, wherein the plurality of sub-fields comprises at least one sub-field having an address period in which a bias voltage is applied to the sustain electrode and a sustain period in which a sustain pulse is not applied to the scan and sustain electrodes.

5. A plasma display panel in which a scan electrode and a sustain electrode are formed on a substrate, wherein the panel is driven so that the number of sustain pulses applied to the scan electrode and the sustain electrode in at least one sub-field in a plurality of sub-fields in a frame is an odd number and wherein the plurality of sub-fields comprises at least one sub-field having an address period in which a bias voltage is applied to the sustain electrode and a sustain period in which a sustain pulse is not applied to the scan and sustain electrodes.

6. A driving method of a plasma display apparatus displaying an image with a plurality of sub-fields, wherein a number of sustain pulses applied in at least one sub-field of the plurality of sub-fields is an odd number and wherein the plurality of sub-fields comprises at least one sub-field having an address period in which a bias voltage is applied to the sustain electrode and a sustain period in which a sustain pulse is not applied to the scan and sustain electrodes.

7. A plasma display apparatus, comprising:

a plasma display panel comprising scan electrodes and a sustain electrode;

a driver driving the scan electrodes and the sustain electrode; and a driving controller controlling the driver to set a first bias voltage applied to the sustain electrode in an address period of at least one of sub-fields constituting a frame, to be different from a second bias voltage which is applied to the sustain electrode in address periods of the remaining sub-fields, wherein the first bias voltage is applied to the sustain electrode while scanning all the scan electrodes of the plasma display panel, and wherein the second bias voltage is applied to the sustain electrode while scanning all the scan electrodes of the plasma display panel.

8. The plasma display apparatus as claimed in claim 7, wherein the driving controller sets the first bias voltage applied to the sustain electrode in an address period of a low gray level sub-field of the sub-fields to be less than the second bias voltage to the sustain electrode in address periods of the remaining sub-fields.

9. The plasma display apparatus as claimed in claim 8, wherein the driving controller sets the first bias voltage applied to the sustain electrode in the address period of the low gray level sub-field to be more than a ground level voltage and less than a sustain voltage.

10. The plasma display apparatus as claimed in claim 8, wherein a pair of sustain pulses are supplied to the scan electrodes and the sustain electrode in a sustain period of the low gray level sub-field.

11. The plasma display apparatus as claimed in claim 8, wherein one sustain pulse is supplied to either the scan electrodes or the sustain electrode in the sustain period of the low gray level sub-field.

12. The plasma display apparatus as claimed in claim 8, wherein a sustain pulse is not supplied to the scan electrodes and the sustain electrode in the sustain period of the low gray level sub-field.

13. The plasma display apparatus as claimed in claim 8, wherein the driving pulse controller controls a ramp-up pulse to be supplied to the scan electrodes and then a ramp-down pulse to be supplied to the scan electrodes in a reset period of the low gray level sub-field.

14. The plasma display apparatus as claimed in claim 8, wherein the driving pulse controller controls a positive voltage to remain constant in the scan electrodes and then a ramp-down pulse to be supplied to the scan electrodes in a reset period in the low gray level sub-field.

15. The plasma display apparatus as claimed in claim 14, wherein the positive voltage is a sustain voltage.

16. The plasma display apparatus as claimed in claim 7, wherein the frame comprises a plurality of low gray sub-fields, and the driving controller controls a ramp-up pulse to be supplied to the scan electrodes and then a ramp-down pulse to be supplied to the scan electrodes, in a reset period in one or more of the plurality of low gray level sub-fields, and controls a positive voltage to remain constant in the scan electrodes and then a ramp-down pulse to be supplied to the scan electrodes, in each reset period of the remaining low gray level sub-fields.

17. The plasma display apparatus as claimed in claim 7, wherein the frame comprises a plurality of low gray sub-fields, and a sustain pulse is not supplied to the scan electrodes and the sustain electrode in each sustain period of one or more of the plurality of low gray level sub-fields, and one sustain pulse is supplied to either the scan electrodes or the sustain electrode in each sustain period of the remaining low gray level sub-fields.

18. The plasma display apparatus as claimed in claim 7, wherein the frame comprises a plurality of low gray sub-fields, and the driving controller sets a bias voltage applied to the sustain electrode in each address period of one or more of the plurality of low gray level sub-fields to be different from the bias voltage applied to the sustain electrode in each address period of the remaining low gray level sub-fields.

19. The plasma display apparatus as claimed in claim 18, wherein the plurality of low gray level sub-fields comprises a first low gray level sub-field and a second low gray level sub-field of which brightness weight is more than the brightness weight of the first low gray level sub-field, and the driving controller controls a bias voltage applied to the sustain electrode in an address period of the second low gray level sub-field to be more than the bias voltage applied to the sustain electrode in the address period of the first low gray level sub-field.

20. A driving apparatus of a plasma display panel comprising scan electrodes and a sustain electrode, comprising:

a driver driving the scan electrodes and the sustain electrode; and a driving controller controlling the driver to set a first bias voltage applied to the sustain electrode in each address period of one or more low gray level sub-fields of sub-fields constituting a frame, to be less than a second bias voltage applied to the sustain electrode in each address period of the remaining sub-fields, wherein the first bias voltage is applied to the sustain electrode while scanning all the scan electrodes of the plasma display panel, and wherein the second bias voltage is applied to the sustain electrode while scanning all the scan electrodes of the plasma display panel.

* * * * *